US008284219B2

(12) United States Patent
Nagumo

(10) Patent No.: US 8,284,219 B2
(45) Date of Patent: Oct. 9, 2012

(54) DRIVE CIRCUIT, OPTICAL PRINT HEAD, AND IMAGE FORMING APPARATUS

(75) Inventor: Akira Nagumo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 333 days.

(21) Appl. No.: 12/687,389

(22) Filed: Jan. 14, 2010

(65) Prior Publication Data

US 2010/0182392 A1 Jul. 22, 2010

(30) Foreign Application Priority Data

Jan. 22, 2009 (JP) ..... 2009-011848

(51) Int. Cl.
*B41J 2/45* (2006.01)

(52) U.S. Cl. ..... 347/132; 347/237; 347/247

(58) Field of Classification Search ..... 347/132, 347/237, 247, 129, 130
See application file for complete search history.

(56) References Cited

U.S. PATENT DOCUMENTS

| | | | | |
|---|---|---|---|---|
| 5,331,192 | A * | 7/1994 | Kudoh | 257/368 |
| 7,531,853 | B2 * | 5/2009 | Saito et al. | 257/272 |
| 7,804,338 | B2 * | 9/2010 | Nagumo | 327/108 |
| 2005/0073264 | A1 * | 4/2005 | Matsumoto | 315/169.3 |
| 2007/0262934 | A1 * | 11/2007 | Fujikawa et al. | 345/82 |
| 2008/0017861 | A1 * | 1/2008 | Ishiguro | 257/59 |
| 2009/0147278 | A1 * | 6/2009 | Tsujino et al. | 358/1.8 |
| 2009/0147512 | A1 * | 6/2009 | Jo | 362/240 |
| 2009/0321751 | A1 * | 12/2009 | Miyao et al. | 257/84 |
| 2010/0097437 | A1 * | 4/2010 | Nagumo | 347/237 |

FOREIGN PATENT DOCUMENTS

| | | | |
|---|---|---|---|
| JP | 03-087071 | A | 4/1991 |
| JP | 2007-053265 | A | 3/2007 |
| JP | 2007-329295 | A | 12/2007 |
| JP | 2008-290277 | | 12/2008 |

* cited by examiner

*Primary Examiner* — Huan Tran

(74) *Attorney, Agent, or Firm* — Kubotera & Associates, LLC

(57) ABSTRACT

A drive circuit for supplying a drive current to a plurality of driven elements includes a plurality of drive output terminals to be connected to the driven elements. The drive output terminals are arranged with a specific pitch in between in an arrangement direction. The drive circuit further includes a plurality of drive transistors. Each of the drive transistors is arranged in an occupied area with a specific width in the arrangement direction larger than the specific pitch.

13 Claims, 21 Drawing Sheets

| Symbol | Piezo resistivity coefficient PMOS [1/Pa] |
|---|---|
| $\Pi_{11}$ | $-66\times10^{-12}$ |
| $\Pi_{12}$ | $11\times10^{-12}$ |
| $\Pi_{44}$ | $-1380\times10^{-12}$ |
| $\Pi_S = \Pi_{11}+\Pi_{12}$ | $-55\times10^{-12}$ |

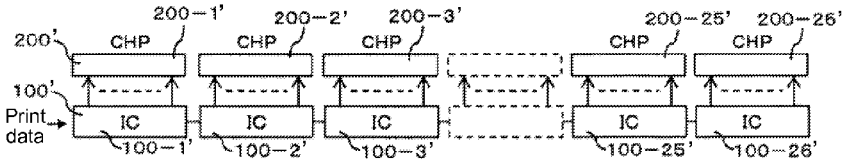
FIG. 13(a) CONVETIONAL ART
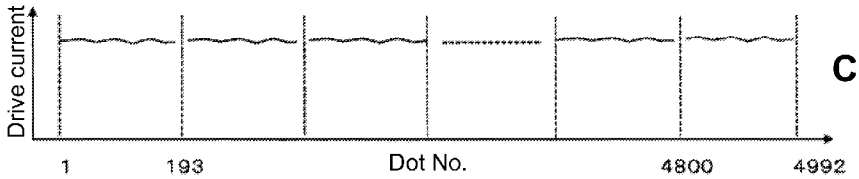
FIG. 13(b) CONVETIONAL ART
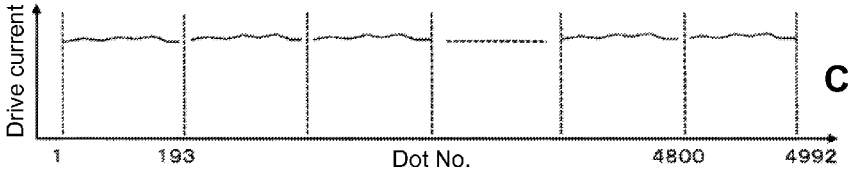
FIG. 13(c) CONVETIONAL ART
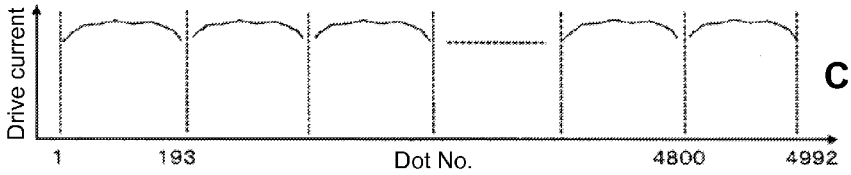
FIG. 13(d) CONVETIONAL ART

DRIVE CIRCUIT, OPTICAL PRINT HEAD, AND IMAGE FORMING APPARATUS

BACKGROUND OF THE INVENTION AND RELATED ART STATEMENT

The present invention relates to a drive circuit for driving a group of driven elements, an optical print head as an LED (Light emitting diode) head including the drive circuit; and an image forming apparatus such as an electro-photography printer including the optical print head. More specifically, the present invention relates to a drive circuit for selectively driving per cycle the group of the driven elements such as an array of LEDs of an image forming apparatus using LEDs as a light source, an array of heating resistor members in a thermal printer, and an array of display elements in a display device.

In a conventional image forming apparatus such as an electro-photography printer using an electro-photography process, an optical print head is formed of a plurality of light emitting elements (for example, LEDs) arranged linearly, so that each of the LEDs emits light to form an image.

In the LED print head, a drive circuit is disposed for driving each of the LEDs. The drive circuit is formed of a drive IC (Integrated Circuit) chip such as a field effect transistor (referred to as an FET). More specifically, a plurality of drive IC chips is arranged linearly on a print circuit board in a pattern corresponding to an arrangement of the LEDs, and the drive IC chips are fixed with a thermally setting resin capable of being thermally cured (refer to Patent Reference).

Patent Reference: Japanese Patent Publication No. 2007-329295

In the conventional LED print head described above, a circuit board unit thereof is formed of the drive IC chips fixed to the print circuit board cured under a high temperature environment. In general, the print circuit board has a thermal expansion coefficient larger than that of the drive IC chips. Accordingly, when the circuit board unit is moved from the high temperature environment to a room temperature environment, a large compressive stress is created in the drive IC chips in an arrangement direction thereof. The compressive stress is applied to a drive transistor in the drive IC chip, thereby varying a drive current thereof. When the drive current is fluctuated, the LED driven with the drive IC chip emits light with fluctuated luminescence. As a result, the electro-photography printer using the conventional LED print head forms an image with a fluctuated density, thereby lowering print quality.

In view of the problems described above, an object of the present invention is to provide a drive circuit capable of solving the problems of the conventional drive circuit.

Further objects and advantages of the invention will be apparent from the following description of the invention.

SUMMARY OF THE INVENTION

In order to attain the objects described above, according to a first aspect of the present invention, a drive circuit for supplying a drive current to a plurality of driven elements includes a plurality of drive output terminals to be connected to the driven elements. The drive output terminals are arranged with a specific pitch in between in an arrangement direction. The drive circuit further includes a plurality of drive transistors. Each of the drive transistors is arranged in an occupied area with a specific width in the arrangement direction larger than the specific pitch.

According to a second aspect of the present invention, a drive circuit includes a plurality of drive transistors for supplying a drive current to a plurality of driven elements. The drive transistors are formed substantially in an L character shape having two sides. The drive transistors have a first gate length on one of the two sides different from a second gate length on the other of the two sides.

According to a third aspect of the present invention, a drive circuit includes a plurality of drive transistors for supplying a drive current to a plurality of driven elements. Each of the drive transistors includes a gate electrode with a rectangular shape, a source region formed along a first side and a second side of the rectangular shape, and a drain region formed along a third side and a fourth side of the rectangular shape.

According to a fourth aspect of the present invention, an optical print head includes a circuit board; a plurality of drive circuits arranged on the circuit board; a light emitting elements array as a plurality of driven elements; and a lens array for collecting light emitted from the light emitting elements array.

According to a fifth aspect of the present invention, an image forming apparatus includes an optical print head, and a photosensitive member facing the optical print head in a direction that the optical print head emits light.

In the present invention, when an environmental temperature of the optical print head changes and a thermal stress is applied to the drive circuit, it is possible to prevent the drive current from fluctuating. Accordingly, it is possible to prevent a print density from fluctuating, thereby providing the image forming apparatus with high quality. Further, it is possible to reduce an occupied area of the drive circuit, thereby reducing a chip area and manufacturing cost.

BRIEF DESCRIPTION OF THE DRAWINGS

FIGS. 13(*a*) to 13(*d*) are schematic views showing an operation of the conventional LED print head at various environmental temperatures;

DETAILED DESCRIPTION OF PREFERRED EMBODIMENTS

Hereunder, preferred embodiments of the present invention will be explained with reference to the accompanying drawings. The drawings are shown for explanations purpose only, and the present invention is not limited to the drawings.

First Embodiment

Figure 2:
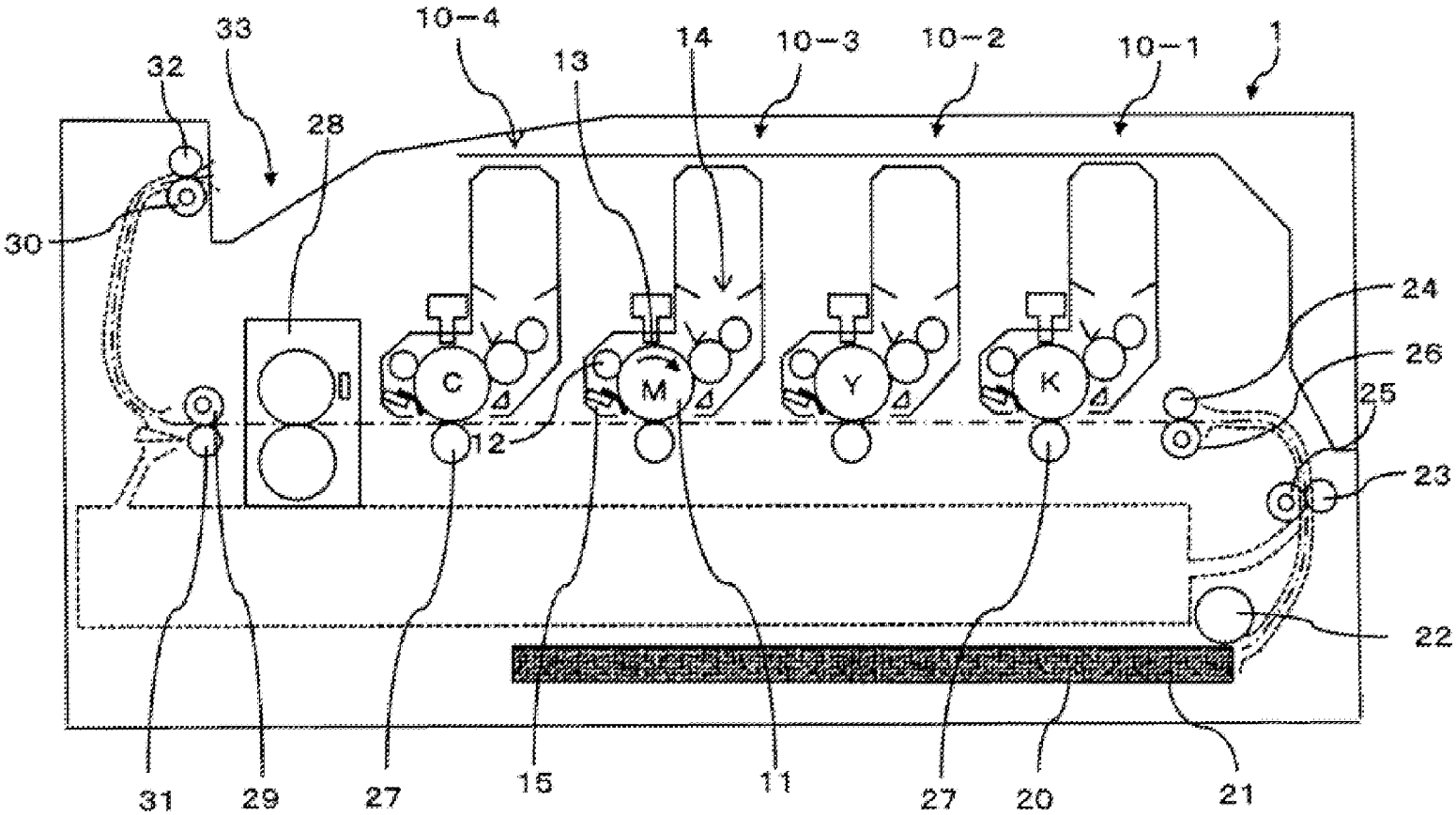
FIG. 2 is a schematic sectional view showing an image forming apparatus according to the first embodiment of the present invention.

A first embodiment of the present invention will be explained. FIG. 2 is a schematic sectional view showing an image forming apparatus 1 according to the first embodiment of the present invention.

In the embodiment, the image forming apparatus 1 is an electro-photography color printer provided with an optical print head (for example, an LED (Light Emitting Diode) print head) formed of light emitting elements (for example, LEDs).

As shown in FIG. 2, the image forming apparatus 1 includes process units 10-1 to 10-4 for forming images in colors of black (K), yellow (Y), magenta (M), and cyan (C), respectively. The process units 10-1 to 10-4 are arranged in this order from an upstream side of a transportation path of a recording medium 20 (for example, a sheet). The process units 10-1 to 10-4 have a similar configuration, and an inner configuration of the process unit 10-3 for forming an image in magenta will be explained as a representative as follows.

In the embodiment, the process unit 10-3 includes a photosensitive drum 11 as an image supporting member arranged to be freely rotatable in an arrow direction in FIG. 2. A charging device 12 for supplying charges to and charging a surface of the photosensitive drum 11 and an exposing device 13 (for example, an LED print head 13) for selectively irradiating the surface of the photosensitive drum 11 to form a static latent image are disposed around the photosensitive drum 11 from an upstream side in a rotational direction thereof.

In the embodiment, the process unit 10-3 further includes a developing device 14 for attaching toner in magenta to the surface of the photosensitive drum 11 with the static latent image formed thereon to form a toner image, and a cleaning device 15 for removing toner remaining on the photosensitive drum 11 after the toner image is transferred to the recording medium 20. A drive source (not shown) transmits drive through a gear and the like to drums and rollers of the components described above to rotate.

In the embodiment, the image forming apparatus 1 further includes a sheet cassette 21 at a lower portion thereof for retaining the recording medium 20 in a stacked state, and a hopping roller 22 is disposed above the sheet cassette 21 for separating and transporting the recording medium 20 one by one. A transportation roller 25 and pinch rollers 23 and 24 are arranged on a downstream side of the hopping roller 22 in a direction that the recording medium 20 is transported for sandwiching and transporting the recording medium 20. Further, a register roller 26 is arranged on the downstream side of the hopping roller 22 for correcting skew of the recording medium 20 and transporting the recording medium 20 to the process unit 10-3. A drive source (not shown) transmits drive through a gear and the like to the hopping roller 22, the transportation roller 25, and the register roller 26 to rotate.

In the embodiment, a transfer roller 27 formed of a semiconductive rubber and the like is disposed in each of the process units 10-1 to 10-4 to face the photosensitive drum 11. A voltage is applied to the transfer roller 27, so that a potential difference is generated between a surface potential of the photosensitive drum 11 and a surface potential of the transfer roller 27, so that the toner image formed on the photosensitive drum 11 is transferred to the recording medium 20.

In the embodiment, a fixing device 28 is disposed on a downstream side of the process unit 10-4. The fixing device 28 includes a heating roller and a back-up roller, so that the fixing device 28 applies pressure and heat to the recording medium 20 to fix the toner image on the recording medium 20. Discharge rollers 29 and 30, pinch rollers 31 and 32 of a discharge portion, and a sheet stacker portion 33 are disposed on the downstream side of the fixing device 28. The discharge rollers 29 and 30 and the pinch rollers 31 and 32 of the discharge portion sandwich the recording medium 20 discharged from the fixing device 28 to transport the recording medium 20 to the sheet stacker portion 33. A drive source (not shown) transmits drive through a gear and the like to the fixing device 28 and the discharges rollers 29 and 30 to rotate.

An operation of the image forming apparatus 1 will be explained next. First, the hopping roller 22 separates and transports the recording medium 20 retained in the sheet cassette 21 in the stacked state one by one. Then, the transportation roller 25, the register roller 26, and the pinch rollers 23 and 24 sandwich the recording medium 20, so that the recording medium 20 is transported between the photosensitive drum 11 and the transfer roller 27 of the process unit 10-1.

In the next step, the photosensitive drum 11 and the transfer roller 27 sandwich the recording medium 20, so that the toner image is transferred to a recording surface of the recording medium 20. Then, the photosensitive drum 11 rotates and transports the recording medium 20 toward the downstream side. In each of the process units 10-1 to 10-4, the LED print head 13 forms the static latent image, and the developing device 14 develops the static latent image to form the toner image in each color. Accordingly, the recording medium 20 sequentially passes through the process units 10-1 to 10-4, so that the toner image in each color is sequentially transferred and overlapped on the recording surface of the recording medium 20.

After the toner image in each color is sequentially overlapped on the recording surface of the recording medium 20, the fixing device 28 fixes the toner images to the recording medium 20. Afterward, the discharge rollers 29 and 30 and the pinch rollers 31 and 32 sandwich the recording medium 20, so that the recording medium 20 is discharged to the sheet stacker portion 33 outside the image forming apparatus 1. Through the steps described above, a color image is formed on the recording medium 20.

Figure 3:
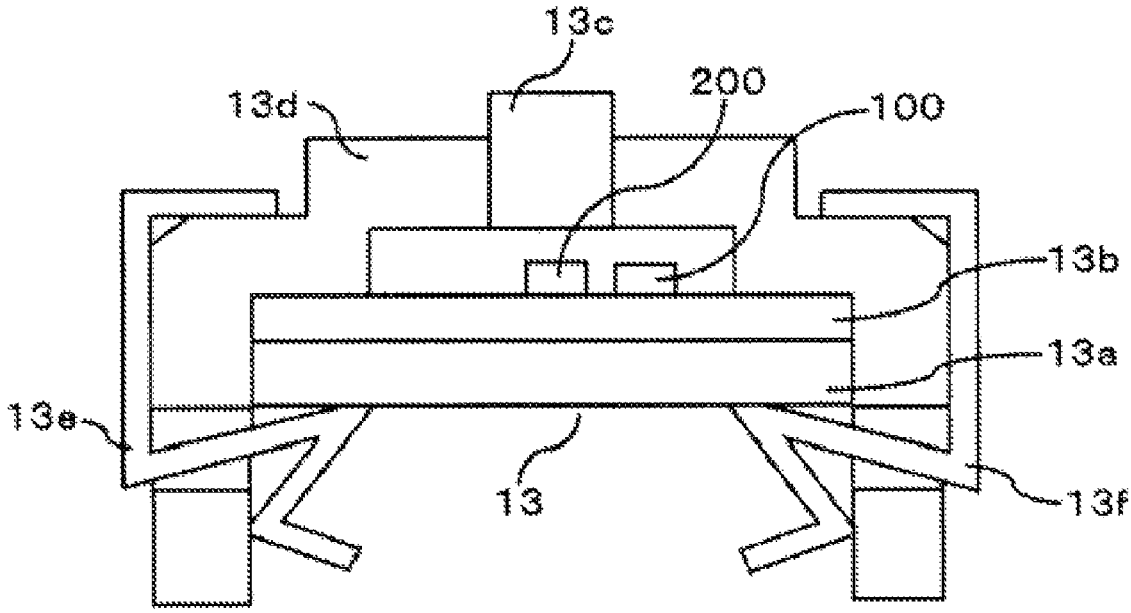
FIG. 3 is a schematic sectional view showing an LED (Light Emitting Diode) print head according to the first embodiment of the present invention.

FIG. 3 is a schematic sectional view showing the LED (Light Emitting Diode) print head 13 according to the first embodiment of the present invention. As shown in FIG. 3, the optical print head 13 is formed of a base member 13*a* and a print circuit board 13*b* fixed to the base member 13*a*. A plurality of driver ICs 100 (Integrated Circuits) formed of drive circuits integrated therein in a chip form and a plurality of LED arrays 200 formed in a chip form are fixed on the print circuit board 13*b* with a thermally setting resin. The driver ICs 100 and the LED arrays 200 are connected with bonding wires and the likes (not shown), respectively.

In the embodiment, a rod lens array 13*c* having a plurality of optical elements with a column shape arranged therein is disposed on the LED array 200, and a holder 13*d* is provided for holding the rod lens array 13*c*. Clamp members 13*e* and 13*f* are provided for fixing the print circuit board 13*b*, the base member 13*a*, and the holder 13*d*.

Figure 4:
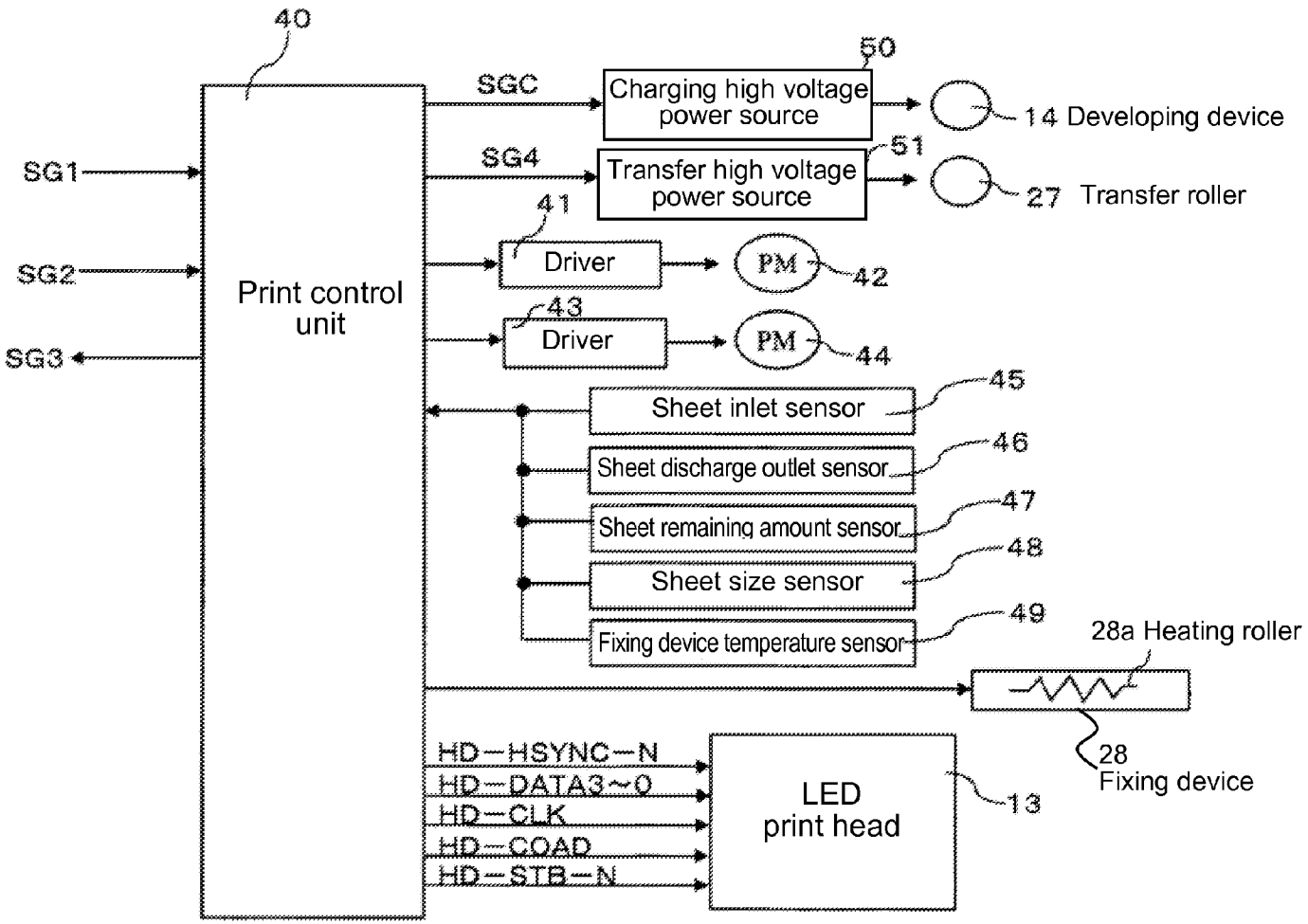
FIG. 4 is a block diagram view showing a printer control circuit according to the first embodiment of the present invention.

FIG. 4 is a block diagram view showing a printer control circuit of the image forming apparatus 1 according to the first embodiment of the present invention.

As shown in FIG. 4, the printer control circuit includes a print control unit 40 disposed inside the image forming apparatus 1 or the electro-photography printer. The print control unit 40 includes a microprocessor, an ROM (Read Only Memory), an RAM (Random Access Memory), an input-output port, a timer, and the likes. The print control unit 40 sequentially controls an entire operation of the image forming apparatus 1 to perform a printing operation according to a control signal SG1, a video signal SG2 (dot map data arranged in a one-dimensional pattern), and the likes sent from a host device (not shown).

In the embodiment, the print control unit 40 is connected to the LED print head 13 of each of the process unit 10-1 to 10-4; the heating roller 28*a* of the fixing device 28; drivers 41 and 43; a sheet inlet sensor 45; a sheet discharge outlet sensor 46; a sheet remaining amount sensor 47; a sheet size sensor 48; a fixing device temperature sensor 49; a charging high voltage power source 50; a transfer high voltage power source 51, and the like. The driver 41 is connected to a developing/transfer process motor (PM) 42. The driver 43 is connected to a sheet transportation motor (PM) 44. The charging high voltage power source 50 is connected to the developing device 14. The transfer high voltage power source 51 is connected to the transfer rollers 27.

An operation of the printer control circuit will be explained next. When the print control unit 40 receives a print instruction through the control signal SG1 from the host device, the print control unit 40 controls the fixing device temperature sensor 49 to determine whether the heating roller 28*a* of the fixing device 28 is within an operable temperature range.

When the heating roller 28*a* is not within the operable temperature range, the heating roller 28*a* is turned on to heat the fixing device 22 to an operable temperature. In the next step, the print control unit 40 controls the driver 41 to rotate the developing/transfer process motor 42. At the same time, according to a charge signal SGC, the print control unit 41 turns on the charging high voltage power source 50 to charge the developing device 14.

In the embodiment, the sheet remaining amount sensor 47 detects the sheet 20, and the sheet size sensor 48 detects a size of the sheet 20, so that the sheet 20 is transported according to a setting suitable for the sheet 20. The sheet transportation motor 44 is rotatable in both directions through the driver 43. First, the sheet transportation motor 44 rotates in a reverse direction to transport the sheet 20 for a specific distance until the sheet inlet sensor 45 detects the sheet 20. Then, the sheet transportation motor 44 rotates in a forward direction to transport the sheet 20 to a print mechanism inside the image forming apparatus 1 or the electro-photography printer.

In the embodiment, when the sheet 20 reaches a printable position of the print mechanism, the print control unit 40 sends a timing signal SG3 (including a main scanning synchronization signal and a sub scanning synchronization signal) to the host device, and receives the video signal SG2. After the host device edits the video signal SG2 per page and sends the video signal SG2 to the print control unit 40, the video signal SG2 is transmitted to each of the LED print heads 13 as print data signals HD-DATA3 to HD-DATA0. In each of the LED print heads 13, a plurality of LEDs is arranged in a substantially linear pattern each for printing one dot (pixel).

In the embodiment, when the print control unit 40 receives the video signal SG2 per print line, the print control unit 40 sends a latch signal HD-LOAD to each of the LED print heads 13, so that the print data signals HD-DATA3 to HD-DATA0 are retained in each of the LED print heads 13. While the print control unit 40 receives a next video signal SG2 from the host device, the print control unit 40 can perform the printing operation of the print data signals HD-DATA3 to HD-DATA0 retained in each of the LED print heads 13.

In the embodiment, the print control unit 40 sends a clock signal HD-CLK, a main scanning synchronization signal HD-HSYNC-N, and a strobe signal HD-STB-N to each of the LED print heads 13. The clock signal HD-CLK is sent for sending the print data signals HD-DATA3 to HD-DATA0 to the LED print heads 13.

In the embodiment, the video signal SG2 is sent and received per print line. Information to be printed with the LED print heads 13 is converted to the static latent image as dots with an increased potential on the photosensitive drums 11 charged with a negative potential. In the developing device 14, toner charged with a negative potential is attracted to the dots of the static latent image through an electric attraction, thereby forming the toner image.

In the next step, the toner image is transported to the transfer rollers 27. The transfer high voltage power source 51 is turned on to have a positive potential according to a transfer signal SG4, so that the transfer rollers 27 transfer the toner images to the sheet 20 passing through between the photosensitive drums 11 and the transfer rollers 27. After the toner images are transferred to the sheet 20, the sheet 20 abuts against the fixing device 28 with the heating roller 28*a*, so that the toner images are fixed to the sheet 20 through heat of the fixing device 28. After the toner images are fixed to the sheet 20, the sheet 20 is discharged from the print mechanism to outside the image forming apparatus 1 or the electro-photography printer through the sheet discharge outlet sensor 46.

In the embodiment, according to the detection of the sheet size sensor 48 and the sheet inlet sensor 45, the print control unit 40 controls the transfer high voltage power source 51 to apply a voltage to the transfer device 28 only when the sheet 20 passes through the transfer device 28. After the printing operation is completed and the sheet 20 passes through the sheet discharge outlet sensor 46, the print control unit 40 controls the charge high voltage power source 50 to stop applying a voltage to the developing device 14. At the same time, the print control unit 40 controls the developing/transfer process motor 42 to stop, thereby repeating the process described above.

Figure 5:
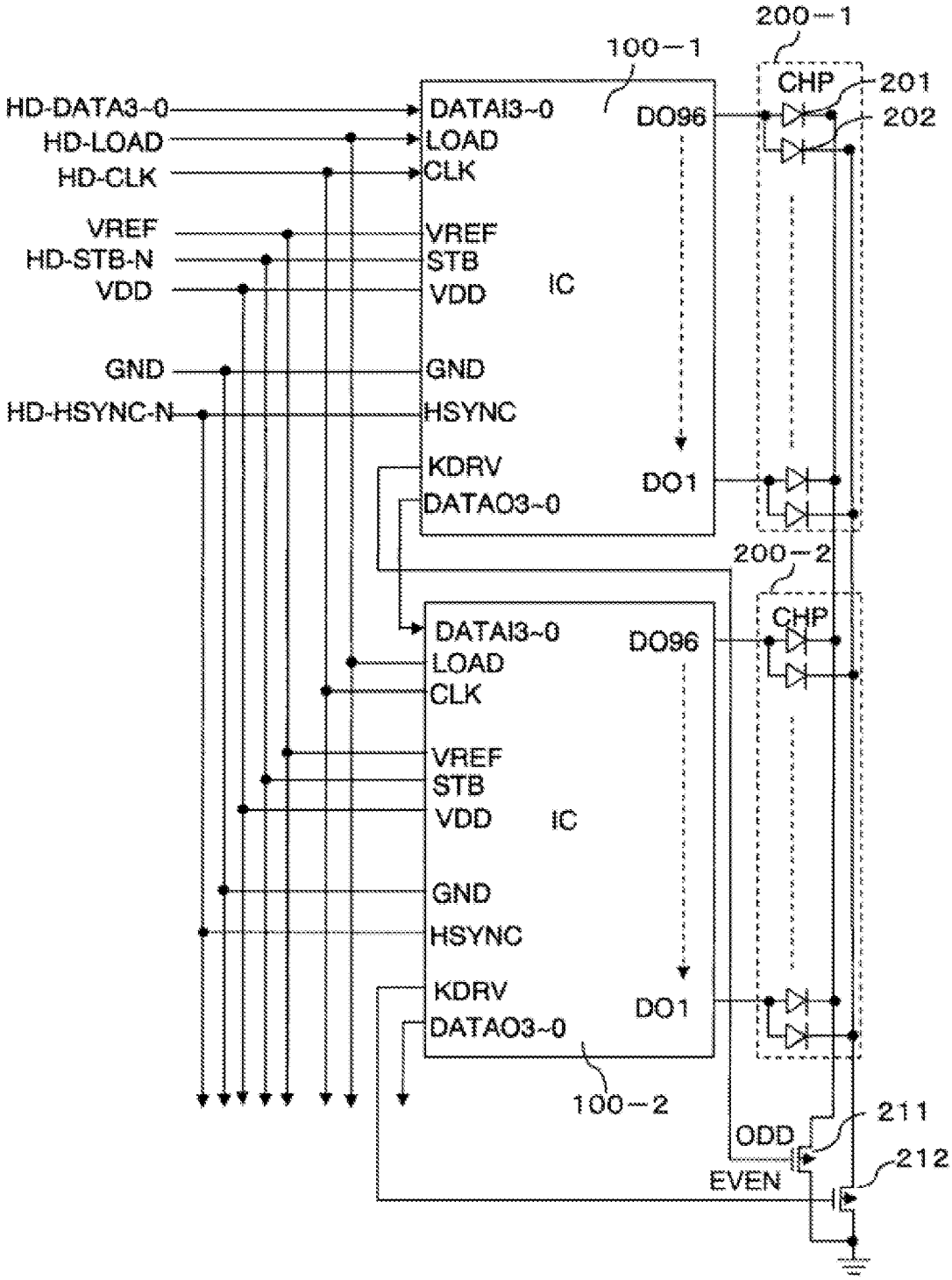
FIG. 5 is a block diagram showing the LED print head according to the first embodiment of the present invention.

FIG. 5 is a block diagram showing the LED print head 13 in each of the process units 10-1 to 10-4 according to the first embodiment of the present invention.

In the embodiment, the LED print head 13 is capable of printing on an A4 size sheet at a resolution of 600 dots per one inch. Further, the LED print head 13 includes 4,992 of LEDs 201, 202, and so on, and the LEDs 201, 202, and so on are arranged in 26 of LED arrays 200-1, 200-2, and so on. Accordingly, each of the LED arrays 200-1, 200-2, and so on includes 192 of the LEDs 201, 202, and so on.

In the embodiment, in each of the LED arrays 200-1, 200-2, and so on, the LEDs 201, 203, and so on at odd numbers have cathodes connected with each other, and the LEDs 202, 204, and so on at even numbers have cathodes connected with each other. Further, the LEDs arranged adjacent to each other such as the LEDs 201 and 202 have anode terminals connected to each other. Accordingly, it is possible to drive the LEDs 201, 203, and so on at odd numbers, and the LEDs 202, 204, and so on at even numbers in a time-sharing manner.

In the embodiment, the LED print head 13 further includes 26 of driver ICs 100-1, 100-2, and so on corresponding to the LED arrays 200-1, 200-2, and so on, respectively. The driver ICs 100-1, 100-2, and so on have an identical circuitry configuration. Further, the driver ICs arranged adjacent to each other such as the driver ICs 100-1 and 100-2 are connected in a cascade manner (lateral connection).

In the embodiment, the LED print head 13 further includes power MOS transistors 211 and 212 (for example, an N-channel MOS transistor or an NMOS) arranged near the LED arrays 200-1, 200-2, and so on for an odd number side and an even number side. The NMOS 211 on the odd number side has a drain connected to the cathodes of the LEDs 201, 203, and so on at odd numbers. The NMOS 212 on the even number side has a drain connected to the cathodes of the LEDs 202, 204, and so on at even numbers. The NMOSs 211 and 212 have sources connected to ground. The NMOS 211 has a gate connected to a KDRV terminal of the driver IC 100-1, and the NMOS 212 has a gate connected to a KDRV terminal of the driver IC 100-2.

An operation of the LED print head 13 shown in FIG. 5 will be explained next. As shown in FIG. 5, there are four lines of print data signals HD-DATA3 to HD-DATA0. It is arranged such that, among eight of the LEDs arranged next to each other, data for four pixels of the LEDs arranged at odd numbers or the LEDs arranged at even numbers are simultaneously output per the clock signal HD-CLK.

Accordingly, the print data signals HD-DATA3 to HD-DATA0 output from the print control unit 40 shown in FIG. 4 are input to the driver ICs 100-1, 100-2, and so on together with the clock signal HD-CLK. As a result, bit data DATAI0 to DATAI3 for 4,992 dots are sequentially transmitted in a shift register formed of a flip-flop circuit (refer to as an FF, described later) in each of the driver ICS 100-1, 100-2, and so on.

In the next step, a latch signal HD-LOAD is input to the driver ICs 100-1, 100-2, and so on, so that the bit data DATAI0 to DATAI3 for 4,992 dots are latched with a latch circuit disposed to correspond to the FF in each of the driver ICS 100-1, 100-2, and so on. Then, among the LEDs 201, 202, and so on, the LEDs corresponding to dot data DO1, DO2, and so on at a high level (referred to as an H level) emit light with the bit data DATAI0 to DATAI3 and a print drive signal HD-STB-N.

In the embodiment, a power source voltage VDD and a ground voltage GND are supplied to the driver ICs 100-1, 100-2, and so on. Further, a synchronization signal HD-HSYNC-N is supplied to the driver ICs 100-1, 100-2, and so on to set an initial state whether the LEDs 201, 203, and so on at odd numbers, or the LEDs 202, 204, and so on at even numbers are driven in the time-sharing manner. Further, a reference voltage VREF is supplied to the driver ICs 100-1, 100-2, and so on to define a drive current value for driving the LEDs. A reference voltage generation circuit is disposed in the LED print head 13 for generating the reference voltage VREF.

Figure 6:
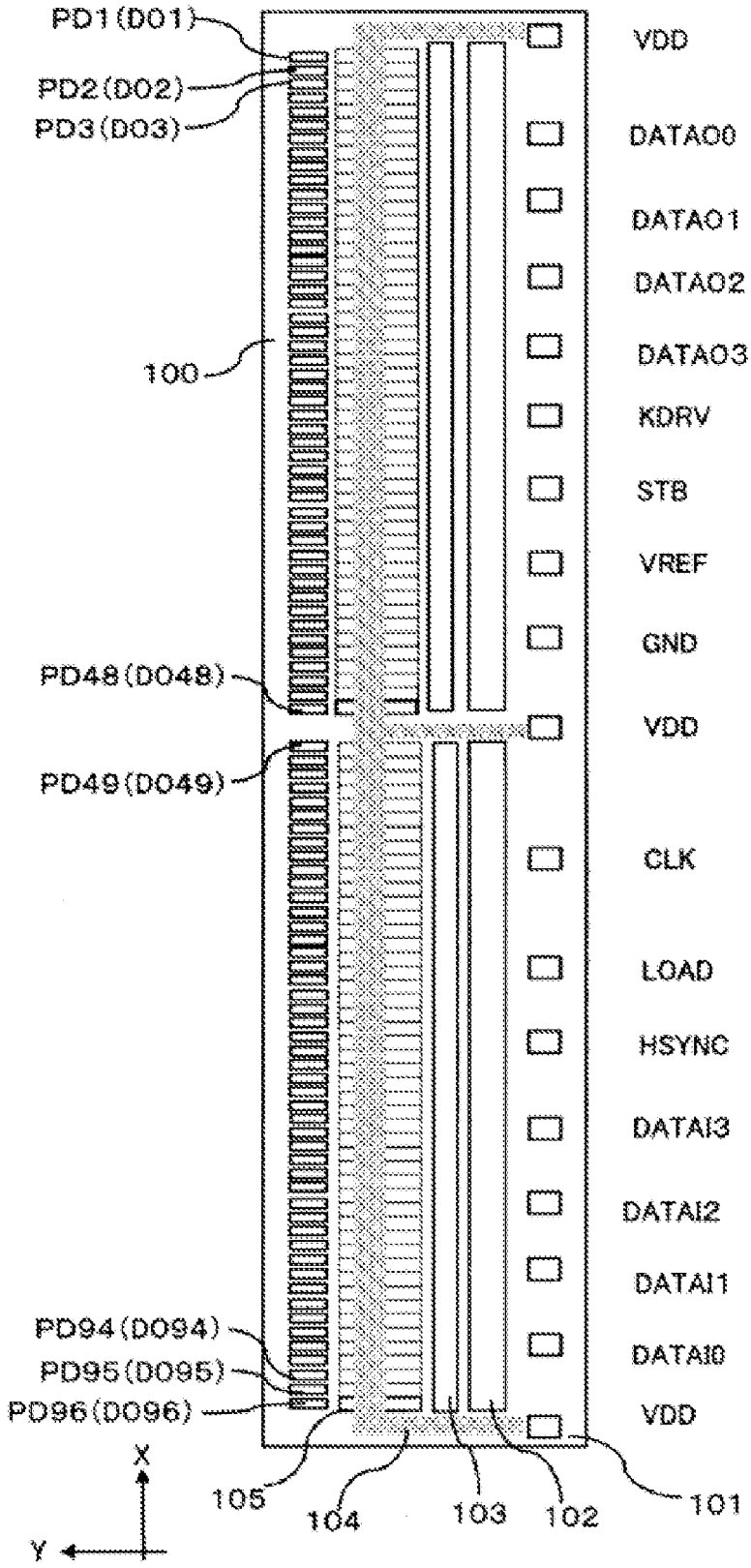
FIG. 6 is a schematic plan view showing a driver IC (Integrated Circuit) according to the first embodiment of the present invention.

FIG. 6 is a schematic plan view showing the driver IC 100 (i.e., 100-1, 100-2, and so on) according to the first embodiment of the present invention. FIG. 6 shows a terminal pad portion and an internal circuit of the driver IC 100 for one chip.

As shown in FIG. 6, the driver ICs 100 includes a terminal pad row 101; a logic circuit row 102 such as the shift resister, the latch circuit, and the like; a front stage circuit 103 of a drive circuit; a power source wiring portion 104; a drive circuit row 105; and drive output terminals (for example, drive current output terminals) PD1 to PD96 as a pad row for the dot data DO1 to DO96 of the drive circuit.

In the embodiment, the terminal pad row 101 includes terminal pads such as the power source voltage VDD; the bit data DATAI0 to DATAI3; the synchronization signal HSYNC; the lacth signal LOAD; the clock signal CLK; the power source voltage VDD; the ground voltage GND; the reference voltage VREF; the print drive signal STB; the gate signal KDRV; the bit data DATAI3 to DATAO0; and the power source voltage VDD in this order. The power source wiring portion 104 is disposed on the drive circuit row 105, and is connected to the VDD terminals in the terminal pad row 101.

Figure 7:
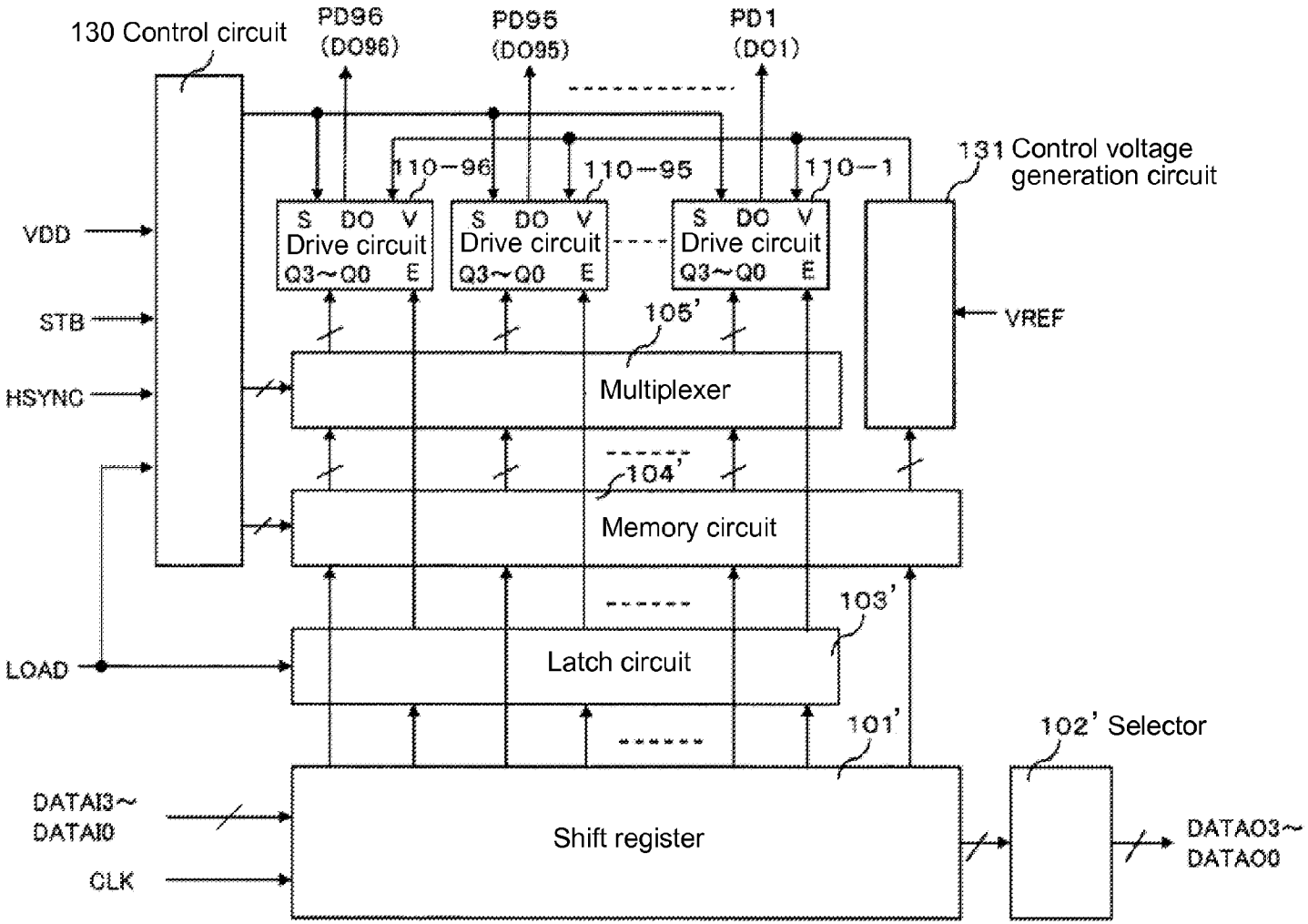
FIG. 7 is a block diagram view showing a detailed configuration of the driver IC according to the first embodiment of the present invention.

A configuration of the driver IC 100 will be explained next. FIG. 7 is a block diagram view showing the detailed configuration of the driver IC 100 according to the first embodiment of the present invention.

As shown in FIG. 7, the driver ICs 100 includes a shift register 101' formed of a plurality of FFs connected in a cascade arrangement. The shift register 101' is a circuit for retrieving and shifting the bit data DATAI3 to DATAI0 in synchronization with the clock signal CLK. The shift register 101' is connected to a selector 102', a latch circuit 103', and a memory circuit 104' on an output side thereof.

In the embodiment, the selector 102' is a circuit for selecting an output of the shift register and for outputting the bit data DATAI3 to DATAI0. The latch circuit 103' is a circuit for latching the output of the shift register 101' with the latch signal LOAD. The memory circuit 104' is a circuit for storing correction data (dot correction data) for correcting a luminescence variance of each LED and luminescence correction data (chip correction data) per the LED array chip, or for storing specific data per the drive IC 100.

In the embodiment, a multiplexer 105' is a circuit for switching between correction data of dots at add numbers and correction data of dots at even numbers among LED dots arranged next to each other among the dot correction data output from the memory circuit 104'. The drive circuits 110-1 to 110-96 for driving the LEDs are connected to an output side of the multiplexer 105'. A control voltage V is applied to each of the drive circuits 110-1 to 110-96. When the drive circuits 110-1 to 110-96 are turned on with an on/off control signal S, the drive circuits 110-1 to 110-96 receive output bit data E of the latch circuit 103' and output correction data Q3 to Q0 of the multiplexer 105', so that the drive circuits 110-1 to 110-96 send output signals DO for turning on the LEDs to the drive current output terminals PD (PD1 to PD96).

In the embodiment, the driver IC 100 includes a control circuit 130 and a control voltage generation circuit 131. The control circuit 130 has functions of receiving the power source voltage VDD, the print drive signal STB, the synchronization signal HSYNC, and the latch signal LOAD, and of generating and supplying the on/off control signal S to the drive circuits 110-1 to 110-96 according to the print drive signal STB and the latch signal LOAD.

Further, the control circuit 130 has functions of generating a writing instruction signal when the correction data are written in the memory circuit 104', and a data switching instruction signal between the odd number dot data and the even number dot data to the multiplexer 105'. The control voltage generation circuit 131 is a circuit for generating the control voltage V for driving the LEDs according to the reference voltage VREF.

In the driver IC 100, the bit data DATAI3 to DATAI0 for the 4,992 dots are sequentially transferred in the shift register 101' with the clock signal CLK. Then, the latch circuit 103' latches the bit data DATAI3 to DATAI0 for the 4,992 dots with the latch signal LOAD. Afterward, the drive circuits 110-1 to 110-96 output the drive currents corresponding to the dot data DO1 to DO96 to the drive current output terminals PD (PD1 to PD96), so that the LEDs corresponding to the dot data DO1 to DO96 with the H level emit light.

Figure 8:
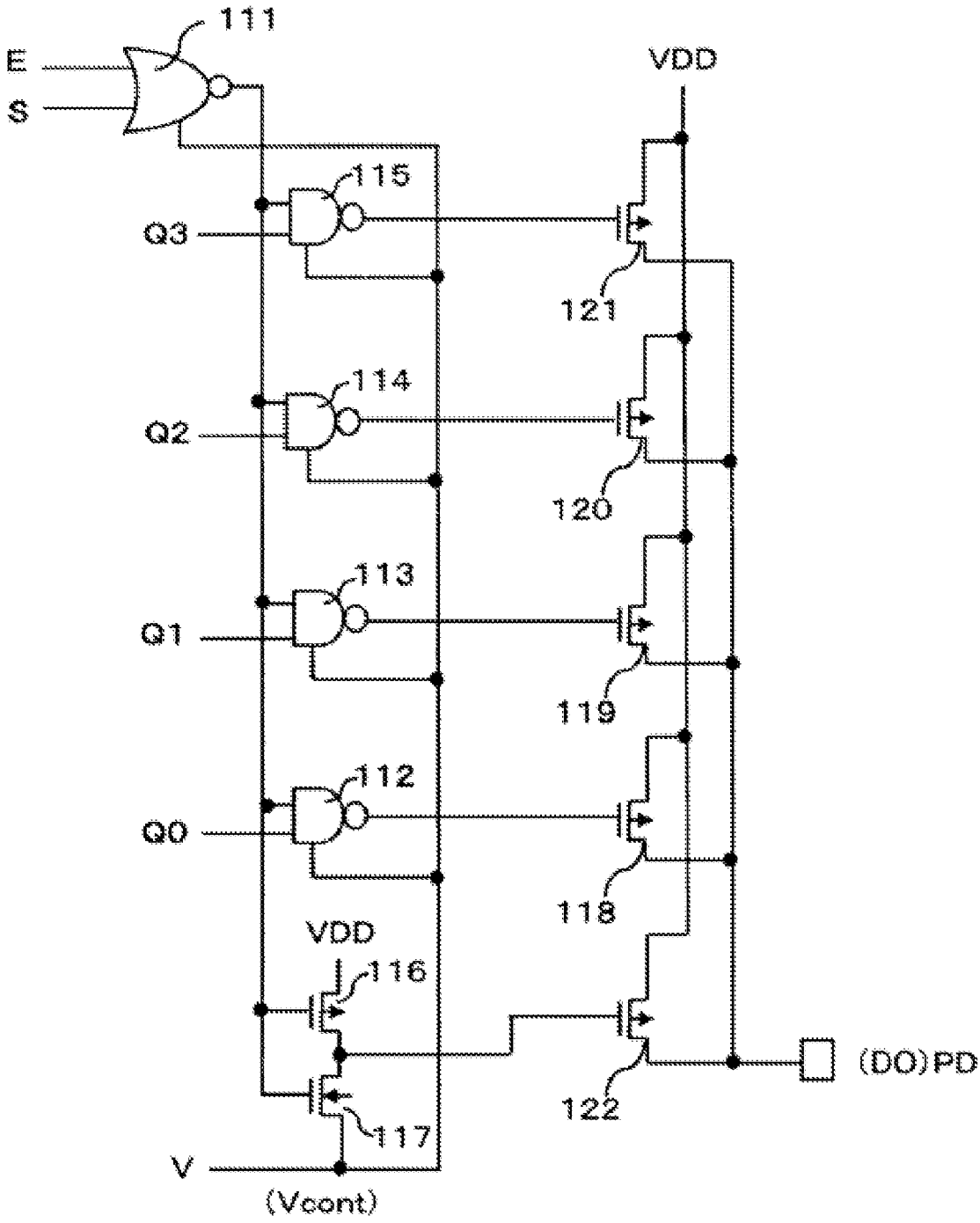
FIG. 8 is a circuit diagram showing a drive circuit of the LED print head according to the first embodiment of the present invention.

A configuration of the drive circuit 110 (110-1 to 110-96) will be explained next. FIG. 8 is a circuit diagram showing the drive circuit 110 of the LED print head 13 according to the first embodiment of the present invention.

As shown in FIG. 8, the drive circuit 110 includes an NOR circuit 111 for determining a logical NOR (referred to as an NOR) of the bit data E from the latch circuit 103' and the on/off control signal S from the control circuit 130. An output side of the NOR circuit 111 is connected to input sides of four logical NAND circuits 112 to 115 (referred to as NAND circuits) and gates of a P-channel MOS transistor 116 (referred to as a PMOS) and an N-channel MOS transistor 117 (referred to as an NMOS) constituting an inverter.

In the embodiment, the NAND circuits 112 to 115 are circuits for determining a logical NAND of output data of the NOR circuit 111 and the correction data from the multiplexer 105'. A terminal of the power source voltage VDD is connected to power source terminals of the NOR circuit 111 and the NAND circuits 112 to 115. A terminal of the control voltage V is connected to ground terminals of the NOR circuit 111 and the NAND circuits 112 to 115, so that the ground terminals are maintained at a control voltage Vcon. The PMOS 116 and the NMOS 117 constituting the inverter are connected in series between the terminal of the power source voltage VDD and the terminal of the control voltage V for inverting and outputting an output signal of the NOR circuit 111.

In the embodiment, output sides of the NAND circuits 112 to 115 are connected to gates of PMOSs 118 to 121, respectively. Further, drains of the PMOS 116 and the NMOS 117 are connected to a gate of PMOS 122. Sources of the PMOSs 118 to 121 are commonly connected to the terminal of the power source voltage VDD, and drains of the PMOSs 118 to 121 are commonly connected to the drive current output terminal PD for the dot data DO. The drive current output terminal PD is connected to anodes of the LEDs through bonding wires and the like (described later).

In the embodiment, as described later, a potential difference between the power source voltage VDD and the control voltage Vcon is substantially equal to a voltage between the gates and the sources of the PMOSs 118 to 122 when the PMOSs 118 to 122 are turned on. Accordingly, it is possible to adjust drain currents of the PMOSs 118 to 122. The control voltage generation circuit 131 shown in FIG. 7 is provided for receiving the reference voltage VREF and controlling the control voltage V, so that the drain currents of the PMOSs 118 to 122 are maintained at a specific level.

A function of the drive circuit 110 will be explained next. When the bit data E as print data from the latch circuit 103' are on (that is, at a low level or an L level), and the on/off control signal S is at the L level to instruct drive-on, the output of the NOR circuit 111 becomes the H level. At this moment, according to the correction data Q3 to Q0 from the multiplexer 105', output signals of the NAND circuits 112 to 115 and an output of the inverter formed of the PMOS 116 and the NMOS 117 become a level of the power source voltage VDD or a level of the control voltage Vcon.

In the embodiment, the PMOS 122 is a main drive transistor for supplying a main drive current to the LEDs, and the PMOSs 118 to 121 are auxiliary drive transistors for adjusting the drive current of the LEDS per dot to correct luminescence thereof. The PMOS 122 as the main drive transistor is driven according to the print data. The PMOSs 118 to 121 as the auxiliary drive transistors are selectively driven according to the correction data Q3 to Q0 from the multiplexer 105' when the output of the NOR circuit 111 is at the H level. The correction data Q3 to Q0 are provided for correcting a variance in luminescence of the dots of the LEDs, and are stored in the memory circuit 104' shown in FIG. 7. The multiplexer 105' selects and supplies the correction data Q3 to Q0.

More specifically, in addition to the PMOS 122 as the main drive transistor, the PMOSs 118 to 121 as the auxiliary drive transistors are selectively driven according to the correction data Q3 to Q0. Accordingly, a drain current of the PMOS 122 as the main drive transistor is added to drain currents of the PMOSs 118 to 121 as the auxiliary drive transistors to become the drive current, and the drive current is output and supplied from the drive current output terminal PD for the dot data DO to the LEDs.

In the embodiment, when the PMOSs 118 to 121 are driven, the outputs of the NAND circuits 112 to 115 are at the L level (that is, a level substantially equal to the control voltage Vcon). Accordingly, gate potentials of the PMOSs 118 to 121 become substantially equal to the control voltage Vcon.

At this moment, the PMOS 116 is turned off, and the NMOS 117 is turned on. Accordingly, a gate potential of the PMOS 122 becomes substantially equal to the control voltage Vcon. As a result, it is possible to collectively adjust the drain current value of the PMOSs 118 to 122 according to the control voltage Vcon. At this moment, the NAND circuits 112 to 115 operate the power source voltage VDD as power source and the control voltage Vcon as a ground potential. Accordingly, it is suffice that an input signal has a potential corresponding to the power source voltage VDD and the control voltage Vcon, and the L level is not necessarily 0 V.

Figure 1:
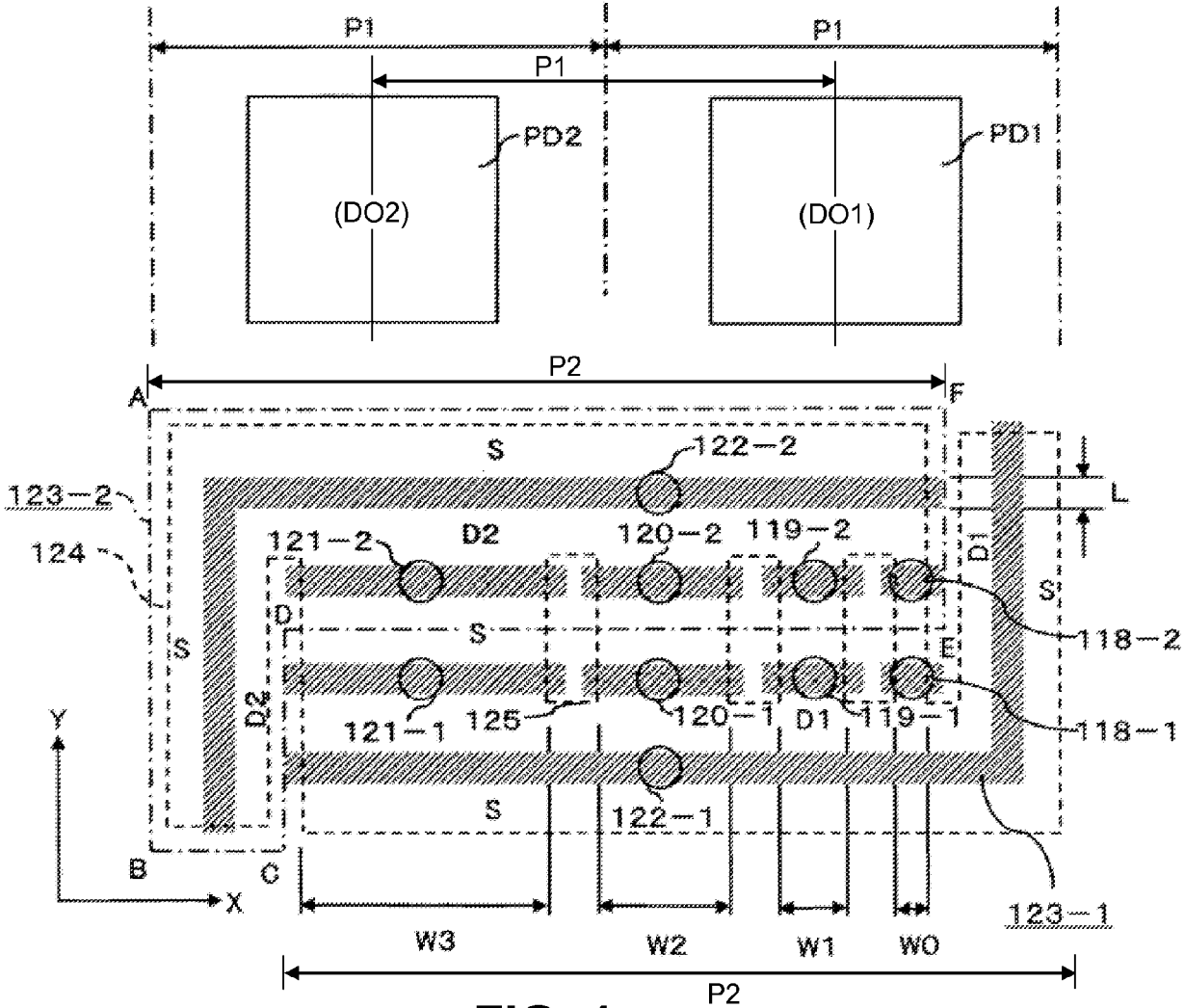
FIG. 1 is a schematic plan view showing a configuration of a drive transistor according to a first embodiment of the present invention.

A configuration of the PMOS 118 to 122 as the drive transistors will be explained next. FIG. 1 is a schematic plan view showing the configuration of the drive transistors shown in FIG. 8 according to the first embodiment of the present invention.

In FIG. 1, the X axis represents along side of the driver IC 100 shown in FIG. 6, and corresponds to an arrangement direction of the driver ICs 100-1, 100-2, and so on shown in FIG. 5. The Y axis represents a short side of the driver IC 100 perpendicular to the X axis. Further, FIG. 1 shows two pairs of the PMOSs 118 to 122 (118-1 to 122-1 and 118-2 to 122-2) and the drive current output terminals PD1 and PD2 for two dot data DO1 and DO2.

In the embodiment, a drive portion 123-2 for driving the drive current output terminal PD2 is disposed in a closed area with a substantially L character shape represented with a projected line passing through points A, B, C, D, E, and F. The drive transistors or the PMOSs 118-2 to 122-2 are formed in the drive portion 123-2. Similarly, a drive portion 123-1 for driving the drive current output terminal PD1 is disposed in a closed area with a substantially L character shape (not shown) arranged in a point symmetry with respect to the drive portion 123-2. The drive transistors or the PMOSs 118-1 to 122-1 are formed in the drive portion 123-1.

In the embodiment, the drive current output terminals PD1 and PD2 are arranged in the X axis direction with a specific arrangement pitch P1. The specific arrangement pitch P1 corresponds to a distance between centerlines of the drive current output terminals PD1 and PD2.

As shown in FIG. 1, each of the drive portions 123-1 and 123-2 is arranged in an occupied area with a specific width P2 in the x axis direction. Further, the drive portions 123-1 and 123-2 corresponding to two circuits are disposed in an occupied area corresponding to two pitches (2×P1). In the embodiment, the specific width P2 is larger than the pitch P1.

As shown in FIG. 1, the gates of the PMOSs 118-1 to 122-1 and 118-2 to 122-2 are represented with hatched areas in band shapes, and are formed of, for example, poly-silicon. A diffused region 124 of a P-type impurity is represented with an area surrounded with a hidden line. The diffused region 124 is surrounded by the closed area passing through the points A, B, C, D, E, and F except three island areas 125 with a rectangular shape surrounded with hidden lines in the diffused region 124.

When the PMOSs 118-1 to 122-1 and 118-2 to 122-2 are formed, after a gate wiring portion is formed, the P-type impurity is introduced into areas except the island regions 125 with the diffused region 124 as an outer boundary and the gate wiring portion as a mask, so that source regions S and drain regions D1 and D2 of the PMOSs 118-1 to 122-1 and 118-2 to 122-2 are formed. The drain region D1 is connected to the drive current output terminal PD1 (through a not shown wiring portion), and the drain region D2 is connected to the drive current output terminal PD2 (through a not shown wiring portion).

In the embodiment, the PMOSs 118-1 to 122-1 and 118-2 to 122-2 are formed in a silicon substrate containing an N-type impurity, for example. After the gate wiring portions represented with hatching are formed, the P-type impurity is introduced into the diffused region 124 represented with the hidden line with the gate wiring portion as the mask. Accordingly, the island regions 125 as the P-type regions are formed in the source regions S and the drain regions D1 and D2, thereby forming the PMOSs 118-1 to 122-1 and 118-2 to 122-2.

Note that, for a simple explanation purpose, a gate oxide film, a metal wiring portion, a contact portion of the source regions S, a contact portion of the drain regions D1 and D2, and a passivation protective film, and the like are omitted in FIG. 1. Further, the source regions S are connected to the power source voltage terminal VDD through metal wiring portions (not shown), and the drain regions D1 and D2 are connected to the drive current output terminal PD1 and PD2 through metal wiring portions (not shown), respectively.

In the embodiment, the PMOSs 118-1 to 121-1 and 118-2 to 121-2 have the gates with gate widths W0, W1, W2, and W3, respectively. The gate width W1 is equal to double of the gate width W0 (W1=2×W0). The gate width W2 is equal to quadruple of the gate width W0 (W2=4×W0). The gate width W3 is equal to eight times of the gate width W0 (W3=8×W0). Further, the gate wiring portions formed of poly-silicon have an identical width L.

Figure 9A:
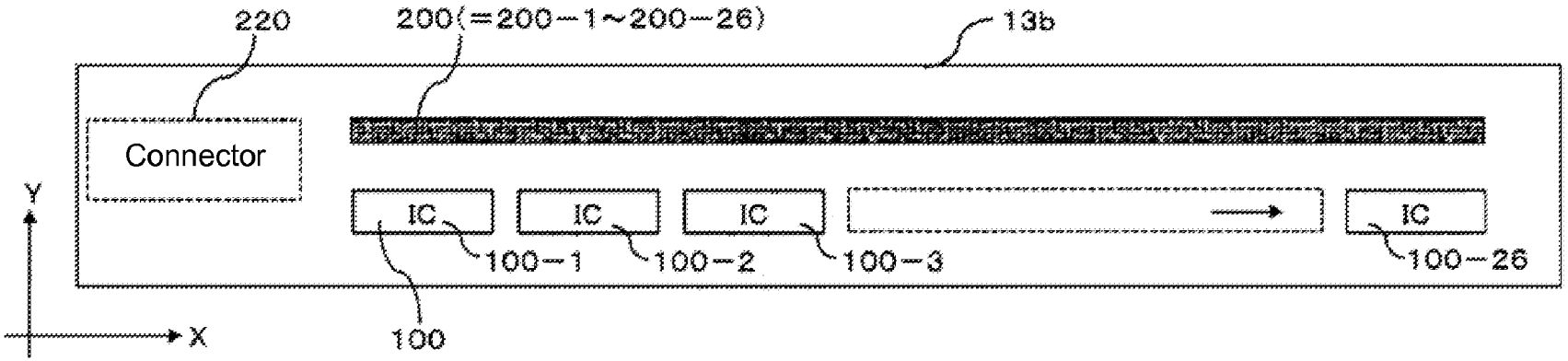
FIGS. 9(*a*) to 9(*c*) are schematic views showing a configuration of a circuit board unit of the LED print head according to the first embodiment of the present invention.
Figure 9B:
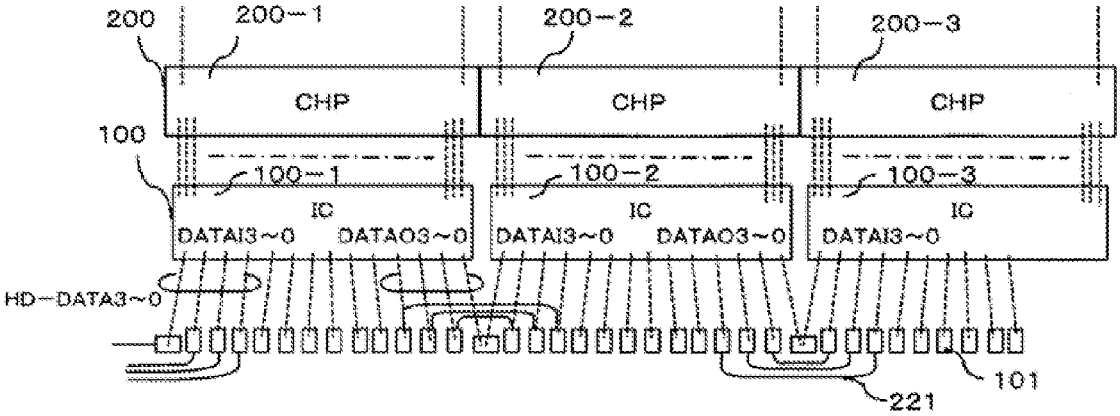
Figure 9C:
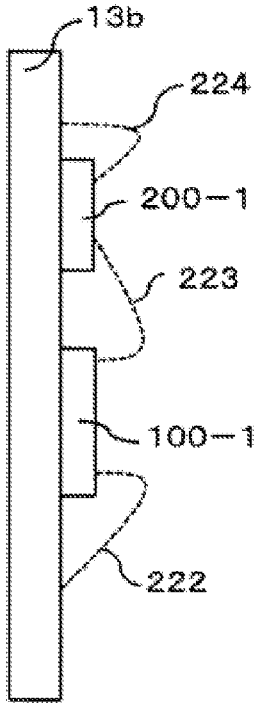

A configuration of a circuit board unit of the LED print head 13 will be explained next. FIGS. 9(*a*) to 9(*c*) are schematic views showing the configuration of the circuit board unit of the LED print head 13 according to the first embodiment of the present invention.

As shown in FIG. 9(*a*), a plurality (for example, 26) of the driver ICs 100 (100-1 to 100-26) is disposed on a flat surface (an upper surface) of the print circuit board 13*b* along the X axis or a longitudinal direction of the print circuit board 13*b*. A plurality (for example, 26) of the LED arrays (CHP) 200 (200-1 to 200-26) is disposed adjacent to the driver ICs 100 along the X axis. Further, a connector 220 is mounted on the upper surface of the print circuit board 13*b*. The connector 220 includes a control signal terminal for controlling the print circuit board unit of the LED print head 13, a power source terminal, a ground terminal, and the like.

As shown in FIG. 9(*b*), the terminal pad row 101 is disposed adjacent to the driver ICs 100-1 to 100-26 on the upper surface of the print circuit board 13*b*. Specific portions of the terminal pad row 101 are connected through wiring portions 221.

As shown in FIG. 9(*c*), the terminal pad row 101 on the print circuit board 13*b* is connected to a control terminal pad of each of the driver ICs 100-1 to 100-26 through a bonding wire 222. The control terminal pad of each of the driver ICs 100-1 to 100-26 is connected to an anode pad of each of the LED arrays 200-1 to 200-26 through a bonding wire 223. The anode pad of each of the LED arrays 200-1 to 200-26 is connected to an electrode pad on the print circuit board 13*b* through a bonding wire 224.

Figures 10A, 10B:
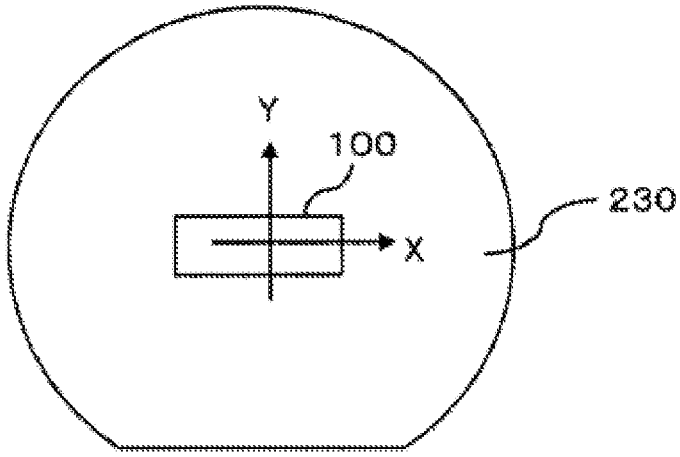
FIGS. 10(*a*) and 10(*b*) are schematic views showing a property change when a stress is applied to a drive transistor according to the first embodiment of the present invention, wherein FIG. 10(*a*) is a schematic view showing an arrangement direction of the driver IC on a silicon wafer, and FIG. 10(*b*) is a table showing relationship equations and values thereof.

A property change (a change in a drain current) of the PMOSs 118 to 122 as the drive transistors shown in FIGS. 8 and 9 will be explained next. FIGS. 10(*a*) and 10(*b*) are schematic views showing the property change when a stress is applied to the drive transistor according to the first embodiment of the present invention. More specifically, FIG. 10(*a*) is a schematic view showing the arrangement direction of the driver IC 100 formed in a silicon wafer 230, and FIG. 10(*b*) is a table showing relationship equations and values thereof.

As shown in FIG. 10(*a*), a plurality of the driver ICs 100 is arranged on the silicon wafer 230, and one of the driver ICs 100 is shown in FIG. 10(*a*). The X axis extends along a long side direction of the driver IC 100, and the Y axis extends along a short side direction of the driver IC 100.

Reference document has disclosed the relationship equations shown in FIG. 10(*b*), the values thereof shown in FIG. 10(*b*), and the following equations (1) and (2). Reference Document Ikeda et al., "Change in mobility of MOSFET in a multi-chip mounting in a chip stack form", Bulletin of the Institute Electronic, Information and Communication Engineers, Vol. J88-C, No. 11, pp 1-8 (11, 2005)

$$\left[\frac{\Delta I_D}{I_D}\right]_0 = \left[\frac{\Delta\mu}{\mu}\right]_0 = \frac{\Pi_S}{2}(\sigma_{11}+\sigma_{22}) + \frac{\Pi_{44}}{2}(\sigma_{11}-\sigma_{22}) \quad (1)$$

-continued $$\left[\frac{\Delta I_D}{I_D}\right]_{90} = \left[\frac{\Delta \mu}{\mu}\right]_{90} = \frac{\Pi_S}{2}(\sigma_{11}+\sigma_{22}) - \frac{\Pi_{44}}{2}(\sigma_{11}-\sigma_{22}) \quad (2)$$

where $\Pi_S$ and $\Pi_{44}$ are piezo resistivity coefficients, and $\sigma_{11}$ and $\sigma_{22}$ are stresses in the Y axis direction and the X axis direction in FIG. 10(*a*), respectively. When the stress $\sigma$ is a compressive stress, the stress $\sigma$ has a negative value. Further, $I_D$ is a drain current of the PMOS and $[\Delta I_D/I_D]_0$ in the equation (1) is a current change rate when the drain current flows in a channel in parallel to the Y axis direction. $[\Delta I_D/I_D]_{90}$ in the equation (2) is a current change rate when the drain current flows in a channel in parallel to the X axis direction.

It is supposed that the current change rate $[\Delta I_D/I_D]_{90}$ is represented with the current change rate $[\Delta I_D/I_D]_X$; the current change rate $[\Delta I_D/I_D]_0$ is represented with the current change rate $[\Delta I_D/I_D]_Y$; the stress $\sigma_{11}$ is represented with the stress $\sigma_Y$; and the stress $\sigma_{22}$ is represented with the stress $\sigma_X$. When the values shown in FIG. 10(*b*) are assigned in the equations (1) and (2), the following equations (3) and (4) are obtained.

$$\left[\frac{\Delta I_D}{I_D}\right]_X = (-717.5\sigma_X + 662.5\sigma_Y)\times 10^{-12}[1/\mathrm{Pa}] \quad (3)$$

$$\left[\frac{\Delta I_D}{I_D}\right]_Y = (662.5\sigma_X - 717.5\sigma_Y)\times 10^{-12}[1/\mathrm{Pa}] \quad (4)$$

In general, when an object is subject to a tensional stress or a compressive stress, the object extends or contracts in a stress direction. At the same time, the object conversely contracts or extends in a direction perpendicular to the stress direction. For example, when a round bar with a diameter d and a length L is pulled in an axial direction thereof with a stress P, the round bar extends by $\Delta L$ in the stress direction. At the same time, the round bar contracts in a radial direction thereof, and the diameter d becomes a diameter d'. In this case, a strain $\epsilon$ in the stress direction is obtained by an equation $\epsilon=\Delta L/L$, and a strain $\epsilon'$ in the direction perpendicular to the stress direction is obtained by an equation $\epsilon'=(d-d')/d$.

A ratio between the strain $\epsilon$ in the stress direction and the strain $\epsilon'$ in the direction perpendicular to the stress direction is a constant depending on a material, and is called Poisson ratio $\upsilon$. Poisson ratio $\upsilon$ is given by the following equation.

$$\upsilon=|\epsilon/\epsilon'|$$

When the strain $\epsilon$ represents extension, the strain $\epsilon'$ represents compression. Accordingly, the Poisson ratio $\upsilon$ between the strain $\epsilon$ and the strain $\epsilon'$ has always a negative value. In the field of Material Science, it is known that an absolute value of Poisson ratio $\upsilon$ is less than 0.5. A relationship between the stress $\sigma$ and the strain $\epsilon$ is given by an equation $\sigma=E\cdot\epsilon$, wherein E is Young's modulus.

In FIG. 10(*a*) it is known that Young's modulus in the X axis direction and the Y axis direction is about 170 GPa ($E\approx 170$ GPa). When it is assumed that Poisson ratio $\upsilon$ is 0.28 and a sign of the stress is considered, the following equation (5) is obtained.

$$\sigma_Y=-\upsilon\sigma_X=-0.28\sigma_X \quad (5)$$

When the equation (5) is substituted in the equations (3) and (4), the following equations (6) and (7) are obtained.

$$\left[\frac{\Delta I_D}{I_D}\right]_X = -903\sigma_X\times 10^{-12}[1/\mathrm{Pa}] \quad (6)$$

$$\left[\frac{\Delta I_D}{I_D}\right]_Y = 863.4\sigma_X\times 10^{-12}[1/\mathrm{Pa}] \quad (7)$$

As shown in the equations (6) and (7), the sign of the current change rate $[\Delta I_D/I_D]_X$ is different from that of the current change rate $[\Delta I_D/I_D]_Y$. Further, when an object is subject to a compressive stress $\sigma$, the compressive stress $\sigma$ has a negative value. Accordingly, when the compressive stress $\sigma$ is applied in the X axis direction, the current change rate $[\Delta I_D/I_D]_X$ has a positive value, and the current change rate $[\Delta I_D/I_D]_Y$ has a negative value.

In this case, when the PMOS is arranged such that the channel thereof is aligned with the X axis direction, the drain current increases. On the other hand, when the PMOS is arranged such that the channel thereof is aligned with the Y axis direction, the drain current decreases.

A ratio of the equations (6) and (7) is obtained by the following equation (8).

$$\frac{\left[\frac{\Delta I_D}{I_D}\right]_Y}{\left[\frac{\Delta I_D}{I_D}\right]_X} = -\frac{863.4}{903} = -0.956 \quad (8)$$

As shown in the equation (8), as opposed to the case that the PMOS is arranged such that the channel thereof is aligned with the X axis direction, when the PMOS is arranged such that the channel thereof is aligned with the Y axis direction, the current change rate becomes about 0.96 times. Accordingly, it is possible to reduce the current change rate by 4%.

Figure 11A:
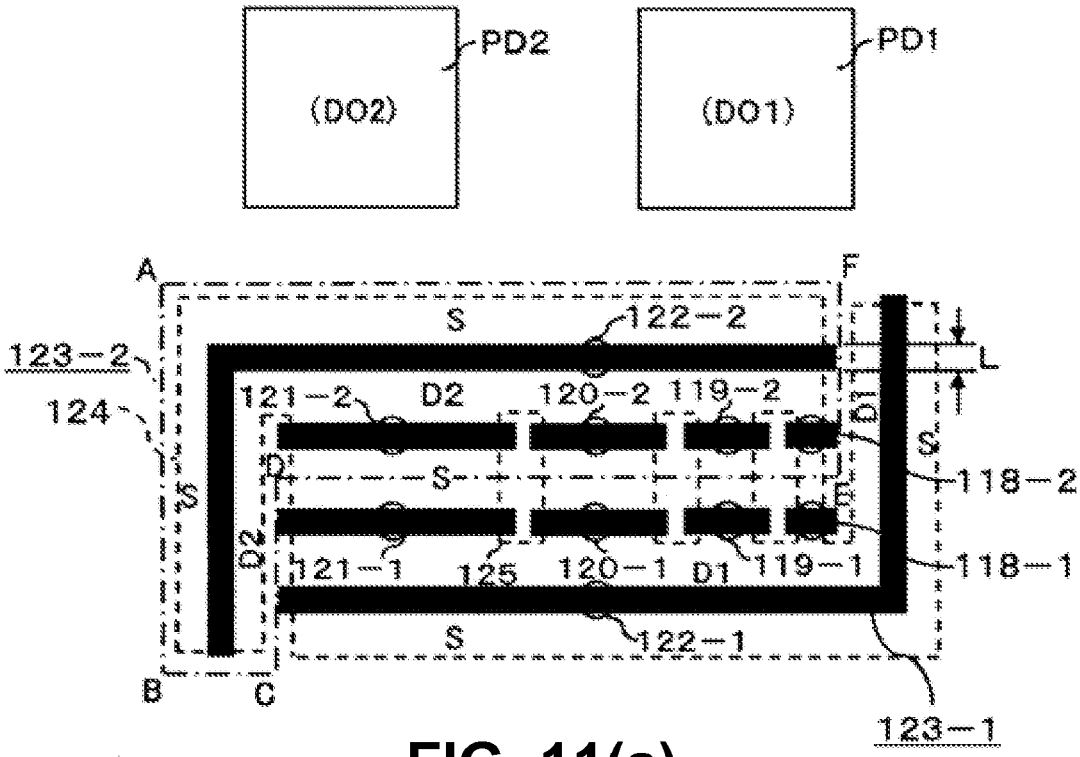
FIGS. 11(*a*) and 11(*b*) are schematic plan views showing an operation of the drive transistor according to the first embodiment of the present invention.
Figure 11B:
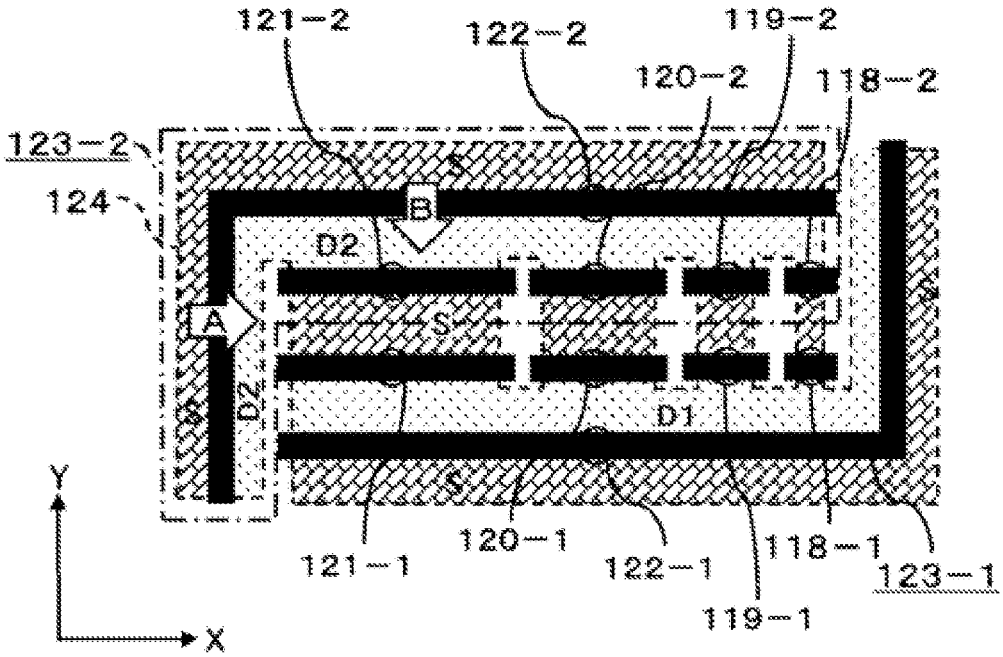

An operation of the drive transistor will be explained next. FIGS. 11(*a*) and 11(*b*) are schematic plan views showing the operation of the drive transistor according to the first embodiment of the present invention. More specifically, FIG. 11(*a*) is a plan view corresponding to FIG. 1, and FIG. 11(*b*) is a plan view without the drive transistor.

In FIGS. 11(*a*) and 11(*b*), for a simple explanation purpose, the gate formed of a poly-silicon is represented with black solid area. The source regions S in FIG. 11(*a*) are represented with dotted hatched regions in FIG. 11(*b*). The drain regions D1 and D2 in FIG. 11(*a*) are represented with grid patterned hatched regions in FIG. 11(*b*).

As shown in FIG. 11(*b*), the PMOS 122-2 is provided as the main drive transistor for supplying the main drive current to the LEDs, and has a gate 122-2G with a substantially L character shape. The source region S and the drain region D2 are arranged on both sides of the gate 122-2G, respectively.

In the embodiment, when the PMOS 122-2 with the substantially L character shape shown in FIG. 11(*a*) is turned on, the drain current flows from the source region S to the drain region D2 in arrow directions A and B shown in FIG. 11(*b*). More specifically, the drain current includes a channel current in the arrow direction A along the X axis direction of the driver IC 100 and a channel current in the arrow direction B along the Y axis direction of the driver IC 100 shown in FIG. 9(*a*).

As quantitatively explained with reference to FIGS. 10(*a*) and 10(*b*), when the compressive stress is applied to the PMOS transistor in the channel direction thereof, the drain current increases according to a level of the compressive stress. At the same time, the drain current decreases in the direction perpendicular to the compressive stress direction.

An operation of the PMOS 122-2 shown in FIG. 11(*b*) at a low temperature will be explained in consideration of the above description. When the PMOS 122-2 with the substantially L character shape is turned on, the drain current flows in the arrow direction A and includes the channel current flowing along the X axis direction of the driver IC 100 shown in FIG. 9(*a*). The X axis direction is aligned with the compressive stress direction, so that the drain current increases. On the other hand, the drain current flowing in the arrow direction B includes the channel current flowing along the Y axis direction of the driver IC 100, and the drain current decreases due to the tensional stress applied in the Y axis direction of the driver IC 100. As a result, a sum of the channel currents flowing in the arrow directions A and B has a small variance due to cancelling out of the increment and the reduction in the channel currents.

In the embodiment, the PMOS 122-2 corresponds to the PMOS 122 shown in FIG. 8, and is provided as the main drive transistor for supplying the main drive current to the LEDs.

As explained above, it is possible to reduce an influence of the stress on the drive current of the main drive transistor. Accordingly, it is possible to significantly reduce an influence of the stress on the drive current output from the drive portion 123-2 formed of the PMOS 118-2 to 122-2.

In the above explanation, Poisson ratio explained with reference to FIGS. 10(*a*) and 10(*b*) is considered (for example, a silicon material is said to have Poisson ratio of about 0.28). In order to effectively reduce the influence of the stress on the drive current output from the drive portion 123-2, it is preferable that a ratio of a length Lx of the gate 122-2G in the X axis direction to a length Ly of the gate 122-2G in the Y axis direction is adjusted according to Poisson ratio.

As explained above, a silicon material is said to have Poisson ratio of about 0.28. According to an experiment (described later) using the LED print head 13, when the ratio of Lx and Ly is 0.7:0.3 (Lx:Ly=0.7:0.3), a flat current distribution was obtained under a low temperature environment. Accordingly, when a ratio of the length Ly to an entire length (Lx+Ly) of the PMOS 122-2 with the substantially L character shape is set between 0.15 and 0.6 (0.15 Ly/(Lx+Ly) 0.6), it is possible to substantially reduce the current fluctuation to a negligible level due to the influence of the stress described above.

Figure 12A:
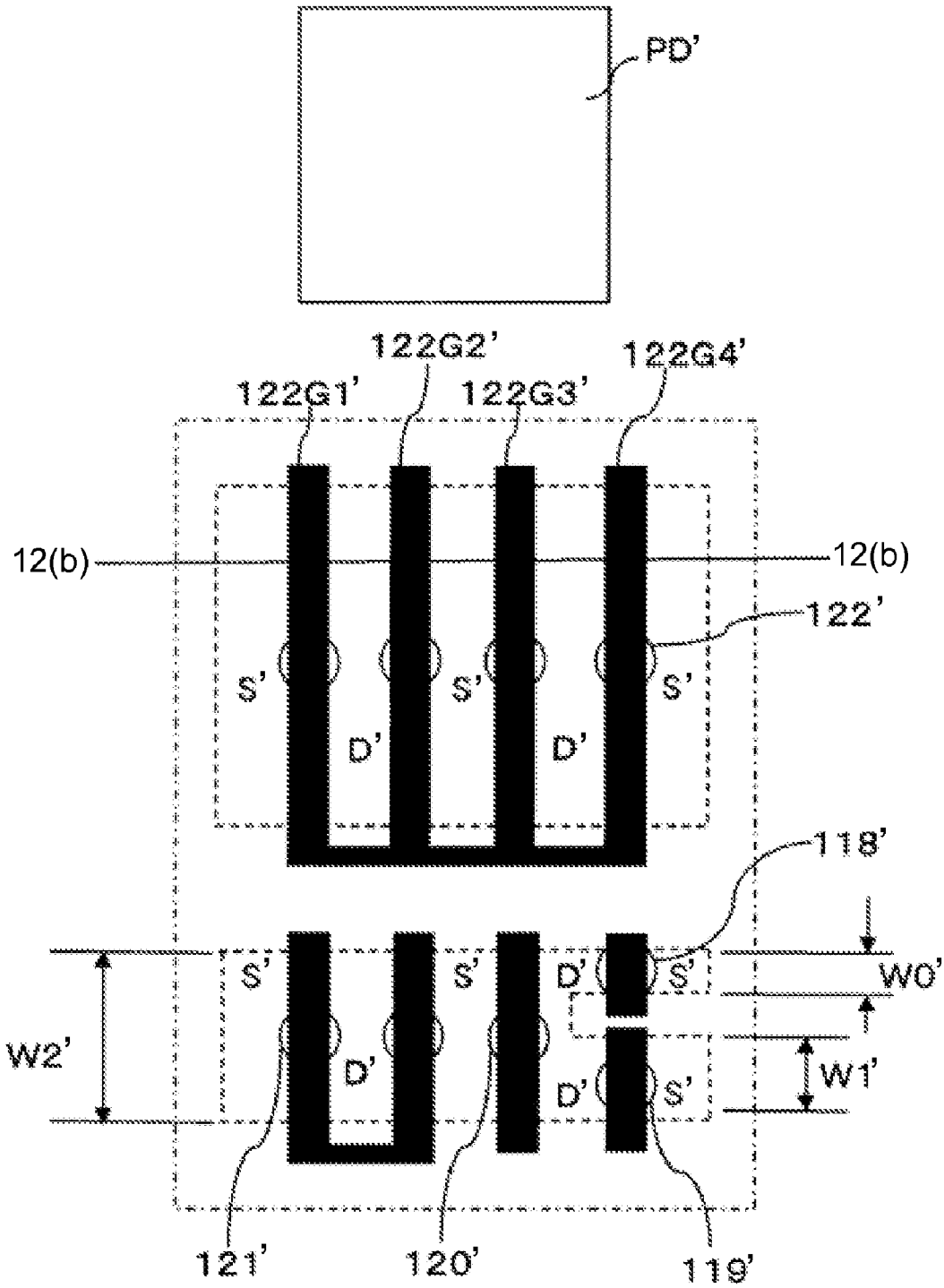
FIG. 12(a) CONVENTIONAL ART
FIGS. 12(*a*) and 12(*b*) are schematic views showing a conventional drive transistor of a conventional LED print head, wherein FIG. 12(*a*) is a schematic plan view of the conventional drive transistor and FIG. 12(*b*) is a schematic sectional view thereof taken along a line 12(*b*)-12(*b*) in FIG. 12(*a*)
Figure 12B:
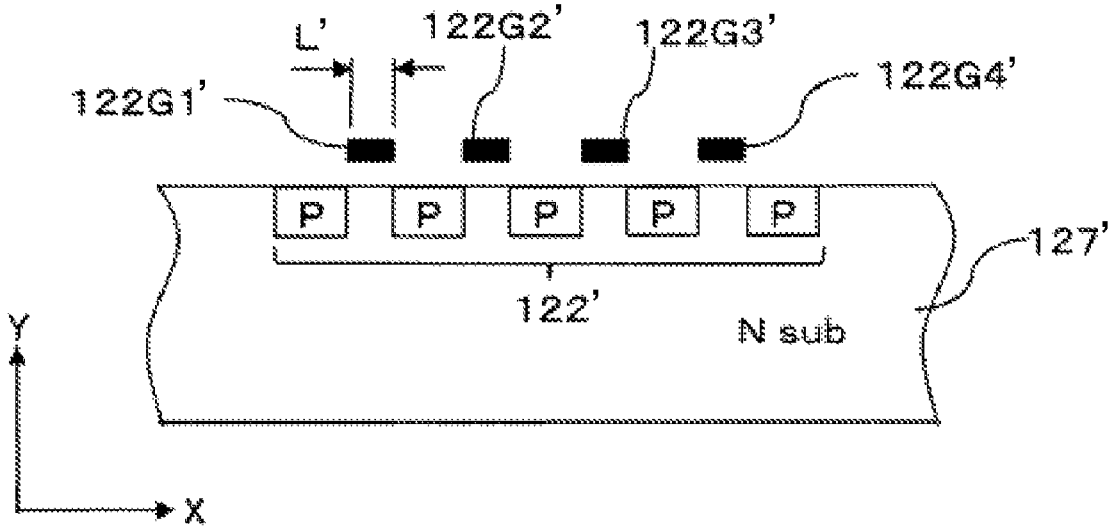
FIG. 12(b) CONVENTIONAL ART
Figure 14A:
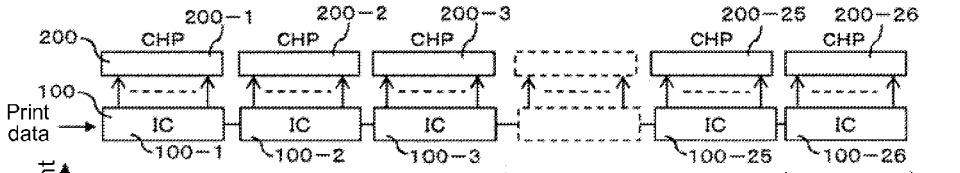
FIGS. 14(*a*) to 14(*d*) are schematic views showing an operation of the LED print head at a low environmental temperature according to the first embodiment of the present invention.
Figure 14B:
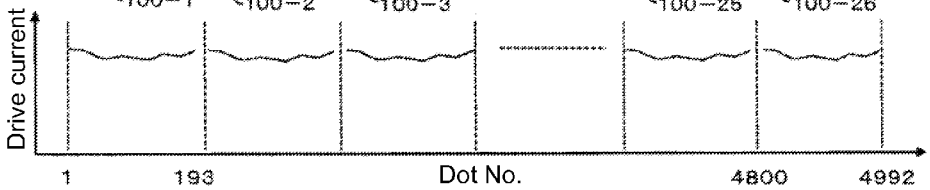
Figure 14C:
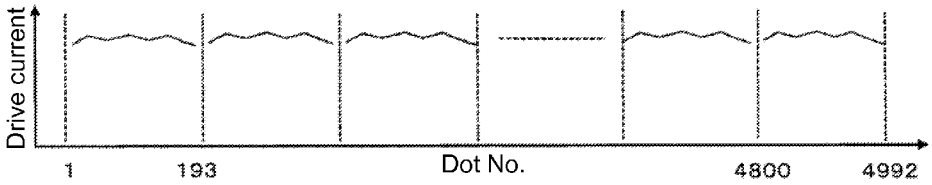
Figure 14D:
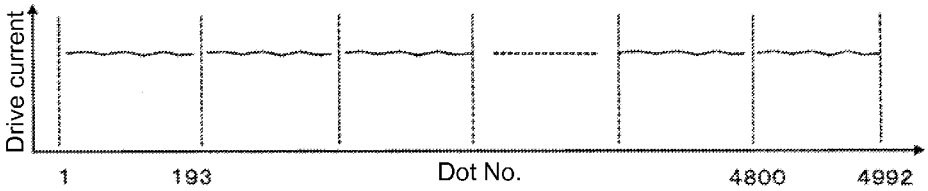

In order to compare with the LED print head 13 in the embodiment, a configuration of a conventional drive transistor of a conventional LED print head will be explained next. FIGS. 12(*a*) and 12(*b*) are schematic views showing the conventional drive transistor of the conventional LED print head. More specifically, FIG. 12(*a*) is a schematic plan view of the conventional drive transistor, and FIG. 12(*b*) is a schematic sectional view thereof taken along a line 12(*b*)-12(*b*) in FIG. 12(*a*).

As shown in FIG. 12(*b*), a PMOS 122' as a main drive transistor; PMOSs 118' to 122' as auxiliary drive transistors; and a drive current output terminal PD' connected to the PMOS 118' to 122' are formed in a silicon substrate 127'. The PMOS 122' is formed of gates 122G1' to 122G4'; and source regions S' and drain regions D' disposed on both sides of the gates 122G1' to 122G4'. Each of the PMOSs 118' to 122' includes a gate, and a source region and a drain region disposed on both sides of the gate.

In the conventional drive transistor, the PMOSs 118' to 120' have the gates with gate widths W0', W1', and W2', respectively. The gate width W1' is equal to double of the gate width W0' (W1'=2×W0'). The gate width W2' is equal to quadruple of the gate width W0' (W2'=4×W0'). The PMOS 122' has a gate width equal to eight times of the gate width W0' (=8×W0').

An operation of the conventional LED print head will be explained next. FIGS. 13(*a*) to 13(*d*) are schematic views showing the operation of the conventional LED print head at various environmental temperatures.

FIG. 13(*a*) is a block diagram of the conventional LED print head corresponding to FIG. 9(*a*). As shown in FIG. 13(*a*), the conventional LED print head includes a plurality of driver ICs 100' (100-1' to 100-26') and a plurality of LED arrays (CHP) 200' (200-1' to 200-26') disposed adjacent to the driver ICs 100'. The PMOSs 118' to 122' as the auxiliary drive transistors have the gates arranged in a direction perpendicular to an arrangement direction of the LED arrays 200' (200-1' to 200-26').

FIG. 13(*b*) is a graph showing each of a drive current of the conventional LED print head at an environmental temperature of 100° C. FIG. 13(*c*) is a graph showing each of the drive currents of the conventional LED print head at an environmental temperature of 25° C. or room temperature. FIG. 13(*d*) is a graph showing each of the drive currents of the conventional LED print head at an environmental temperature of −20° C. Note that FIGS. 13(*b*) to 13(*d*) show the graphs corresponding to the block diagram shown in FIG. 13(*a*), and the driver ICs 100' are divided at boundaries represented with a hidden line.

As shown in FIG. 13(*b*), although the drive currents show a slight variance, each of the drive transistors outputs a substantially uniform output drive current, and shows a substantially flat drive output profile. On the other hand, as shown in FIG. 13(*c*), the drive currents start showing a peak at a middle portion thereof. At the environmental temperature of −20° C. as shown in FIG. 13(*d*), the drive currents of the driver ICs 100' exhibit a curved profile having a peak at a middle portion thereof and decreases at end portions thereof.

When a stress is applied to the driver ICs 100' of the conventional LED print head, the drive currents vary, a phenomenon known as a piezo resistance effect and the like. To this end, for example, Patent Reference has disclosed a technology, in which a film stress is created on an element surface of a silicon wafer to increase carrier mobility of an MOS transistor, thereby improving drive capacity. Further, Patent Reference has disclosed a stress influence on a gate length and a drain current of the MOS transistor.

Patent Reference: Japanese Patent Publication No. 2007-329295

Further, there has been known a phenomenon, in which when a compressive stress is applied in a channel direction of a PMOS transistor to improve drive capacity thereof, carrier mobility thereof increases. On the contrary, when a tensional stress is applied, the carrier mobility thereof decreases. The phenomenon becomes more evident in a case of a MOS transistor with a short channel.

Using the phenomenon described above, in order to improve drive capacity of a PMOS transistor, there has been proposed technologies, in which a germanium layer is formed during an epitaxial film forming step using a silicon wafer to create a compressive stress in a wafer surface; or a structure of a shallow trench is adjusted to apply a stress in a channel of a transistor.

As described above, there has been an effort to improve the drive capacity of the PMOS transistor through utilizing the physical property or the stress creating structure without an expensive fine processing technology in the semiconductor manufacturing process. In the case of the LED print head, in which a thermal stress is applied to the driver IC to change the property thereof, there has been little effort to solve the problem.

When the conventional LED print head is produced, the driver ICs 100' are fixed to a print circuit board using a thermally setting resin at a high environmental temperature. Accordingly, at a temperature close to the high environmental temperature, the driver ICs 100' are in a natural state and little stress is applies to the driver ICs 100'. However, when the conventional LED print head is cooled down to a room temperature, the print circuit board contracts to a larger extent, so that a compressive stress is applied to the driver ICs 100' in parallel to an arrangement direction thereof.

When a compressive stress is applied to each of the driver ICs 100', a difference in the compressive stress may occur between the driver ICs 100' arranged at a middle portion and the driver ICs 100' arranged at an end portion, thereby causing a variance in the drive currents thereof. When a variance in the drive currents occurs, the conventional LED print head emits light with fluctuated luminescence, thereby deteriorating image quality. Further, in the conventional LED print head, an LED may have fluctuated luminescence efficiency due to a manufacture variance. To this end, the conventional LED print head is generally provided with a luminescence correction function for correcting the variance in the LEDs when the conventional LED print head is produced.

However, the compressive stress described above depends on a temperature. More specifically, when the conventional LED print head is in a relatively high temperature environment, the compressive stress is relieved to some extent. However, when the conventional LED print head is in a low temperature environment, the compressive stress significantly increases. As s result, although the luminescence variance is not evident at a temperature at which the luminescence correction is performed, the luminescence variance occurs between the driver ICs 100' arranged at the middle portion and the driver ICs 100' arranged at the end portion due to the variance in the drive currents. Accordingly, even when the conventional LED print head is provided with the luminescence correction function, it is difficult to reduce a variance in a print density.

An operation of the LED print head 13 will be explained next as compared with the conventional LED print head described above. FIGS. 14(*a*) to 14(*d*) are schematic views showing the operation of the LED print head 13 at a low environmental temperature (about −20° C.) according to the first embodiment of the present invention.

FIG. 14(*a*) is a block diagram of the LED print head 13 corresponding to FIG. 9(*a*). Note that FIGS. 14(*b*) to 14(*d*) show the graphs corresponding to the block diagram shown in FIG. 14(*a*), and the driver ICs 100 are divided at boundaries represented with a hidden line.

FIG. 14(*b*) is a graph showing each of the drive currents of the LED print head 13 at the low environmental temperature. The drive currents correspond to the drain current components of the PMOS 122-2 at the gate 122-2G in the arrow direction B shown in FIG. 11(*b*). As shown in FIG. 14(*b*), each of the drive currents of the driver ICs 100 exhibits a downwardly curved profile having a slight decline at a middle portion thereof and a slight increase at an end portion thereof.

FIG. 14(*c*) is a graph showing each of the drive currents of the LED print head 13 at the low environmental temperature. The drive currents correspond to the drain current components of the PMOS 122-2 at the gate 122-2G in the arrow direction A shown in FIG. 11(*b*). As shown in FIG. 14(*c*), each of the drive currents of the driver ICs 100 exhibits an upwardly curved profile having a slight increase at a middle portion thereof and a slight decline at an end portion thereof.

As explained with reference to FIGS. 11(*a*) and 11(*b*), the drain current includes the channel current in the arrow direction B along the Y axis direction perpendicular to the direction (X) in which the thermal stress is received from the print circuit board 13*b* when the LED print head 13 is placed in a low temperature environment. Accordingly, as explained with reference to FIGS. 10(*a*) and 10(*b*), the current change rate expressed with the equation (7) has a positive coefficient. Further, when an object is subject to a compressive stress σ, the compressive stress σ has a negative value. Accordingly, under the low temperature environment, the drive current or a dot current of the driver IC 100 has the downwardly curved profile having the slight decline at the middle portion thereof corresponding to the graph shown in FIG. 14(*b*).

Further, as shown in FIGS. 11(*a*) and 11(*b*), the drain current includes the channel current in the arrow direction A along the X axis direction in parallel to the direction (X) in which the thermal stress is received from the print circuit board 13*b* when the LED print head 13 is placed in a low temperature environment. Accordingly, as explained with reference to FIGS. 10(*a*) and 10(*b*), the current change rate expressed with the equation (6) has a negative coefficient. Further, when an object is subject to a compressive stress σ, the compressive stress σ has a negative value. Accordingly, under the low temperature environment, the current change rate has a positive value, and the drive current or a dot current of the driver IC 100 has the upwardly curved profile having the slight increase at the middle portion thereof corresponding to the graph shown in FIG. 14(*c*).

FIG. 14(*d*) is a graph showing each of total drive currents of the LED print head 13 controlled with an entire portion of the gate 122-2G of the PMOS 122-2, and corresponding to a sum of the drive currents or the dot currents shown in FIGS. 14(*b*) and 14(*c*).

As explained above, in FIG. 14(*b*), each of the drive currents of the driver ICs 100 exhibits the downwardly curved profile having the slight decline at the middle portion thereof and the slight increase at the end portion thereof. In FIG. 14(*c*), each of the drive currents of the driver ICs 100 exhibits the upwardly curved profile having the slight increase at the middle portion thereof and the slight decline at the end portion thereof. Accordingly, as shown in FIG. 14(*d*), as the sum of the drive currents shown in FIGS. 14(*b*) and 14(*c*), each of the drive currents exhibits a relatively flat profile having a relatively uniform value both at a middle portion and an end portion thereof.

As apparent from the comparison with the conventional LED print head shown in FIGS. 13(*b*) to 13(*d*), in the embodiment, the driver ICs 100 output the drive currents with a less variance as shown in FIGS. 14(*b*) to 14(*d*). Accordingly, in the image forming apparatus 1 with the LED print head 13, it is possible to obtain high print quality.

As shown in FIG. 1, in the embodiment, the drive transistors are arranged in the X axis direction with the arrangement width substantially double of the arrangement pitch P1 of the drive current output terminals PD1 and PD2. Further, the PMOSs 122-1 and 122-2 as the main drive transistors have the substantially L character shape. Further, the drive portion 123-1 for driving the drive current output terminal PD1 is arranged in the point symmetry with respect to the drive portion 123-2 for driving the drive current output terminal PD2, and an entire shape thereof is rectangular. Accordingly, it is possible to reduce an occupied area of the drive transistors of the driver IC 100, thereby reducing a chip area and manufacturing cost.

As described above, in the LED print head 13 in the embodiment, it is possible to reduce the difference in the drive currents at the end portion of the driver IC 100 and the middle portion of the driver IC 100 as opposed to the conventional configuration, thereby obtaining the drive currents in the driver IC 100 with the improved variance. Accordingly, it is possible to reduce a variance in the print density, and to provide the image forming apparatus 1 with high print quality.

Further, in the embodiment, the image forming apparatus 1 is provided with the LED print head 13, so that it is possible to provide the image forming apparatus 1 with high quality having good space efficiency and high luminescence efficiency. Further, with the LED print head 13, in addition to the image forming apparatus 1 of the full-color type, it is possible to obtain similar effects in an image forming apparatus of a monochrome type or a multi-color type. It is possible to obtain more significant effects in the image forming apparatus 1 of the full-color type, in which it is necessary to provide a plurality of exposure devices.

As apparent from the comparison with the conventional LED print head shown in FIG. 12(*a*), in the embodiment shown in FIG. 1, the PMOSs 118-1 to 122-1 and 118-2 to 122-2 as the drive transistors are arranged in the X axis direction with the arrangement width substantially double of the arrangement pitch P1 of the drive current output terminals PD1 and PD2. Further, the PMOSs 122-1 and 122-2 as the main drive transistors have the substantially L character shape. Further, the drive portion 123-1 for driving the drive current output terminal PD1 is arranged in the point symmetry with respect to the drive portion 123-2 for driving the drive current output terminal PD2, and an entire shape thereof is rectangular, thereby eliminating a waste chip area. Accordingly, it is possible to reduce the occupied area of the PMOSs 118-1 to 122-1 and 118-2 to 122-2 as the drive transistors of the driver IC 100 in the Y axis direction, thereby reducing a chip area and manufacturing cost.

Second Embodiment

A second embodiment of the present invention will be explained next. In the second embodiment, a drive transistor has a configuration different from that the drive transistors shown in FIG. 1 in the first embodiment. Other components in the second embodiment are similar to those in the first embodiment, and only the drive transistor with the different configuration will be explained.

Figure 15:
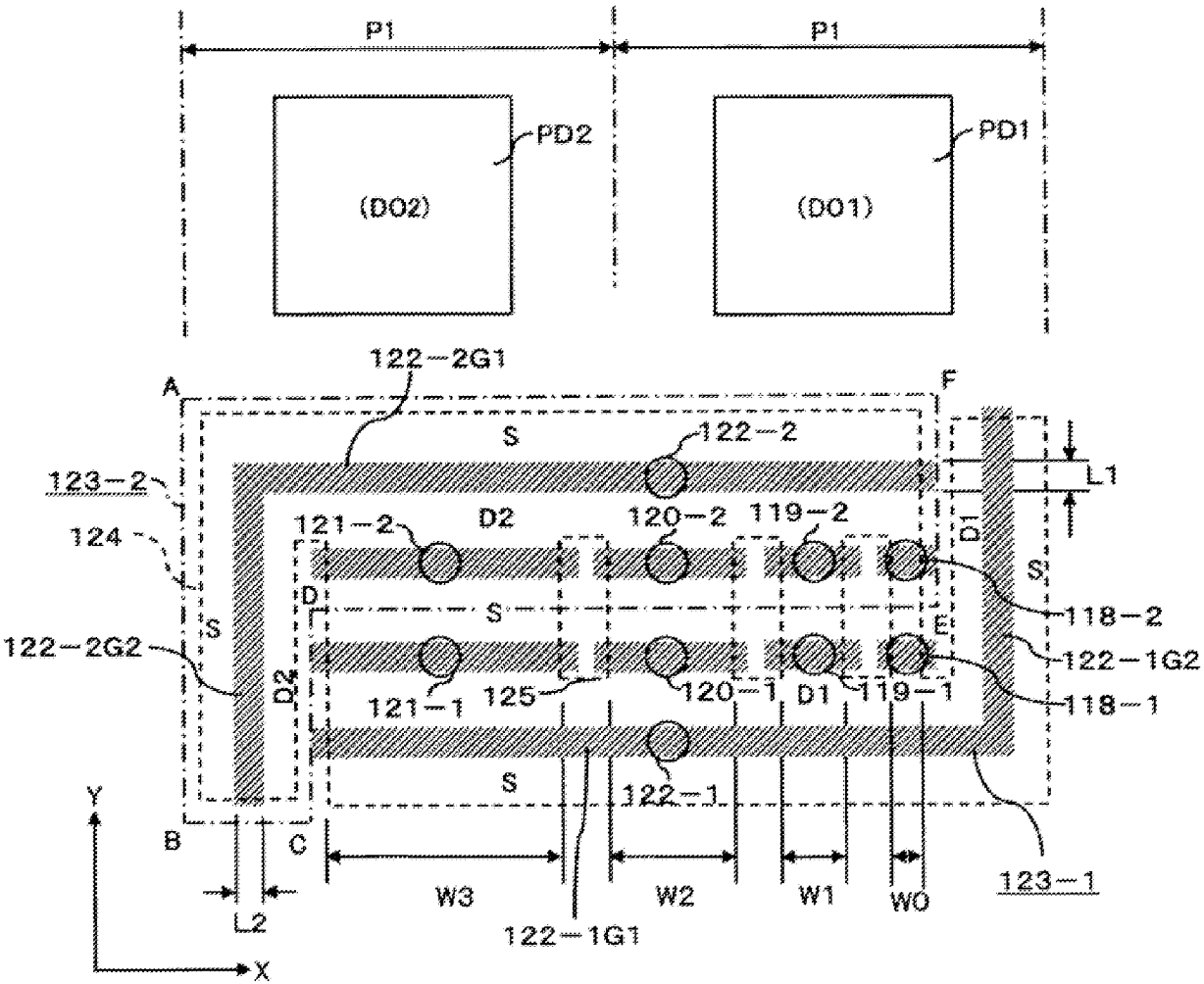
FIG. 15 is a schematic plan view showing a configuration of a drive transistor according to a second embodiment of the present invention.
Figure 16A:
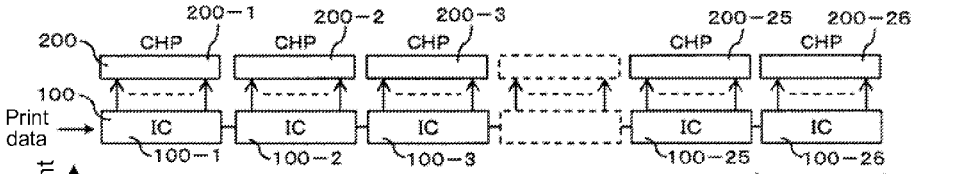
FIGS. 16(*a*) to 16(*d*) are schematic views showing an operation of an LED print head at a low environmental temperature according to the second embodiment of the present invention.
Figure 16B:
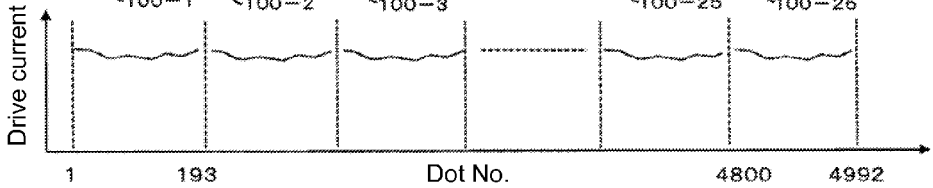
Figure 16C:
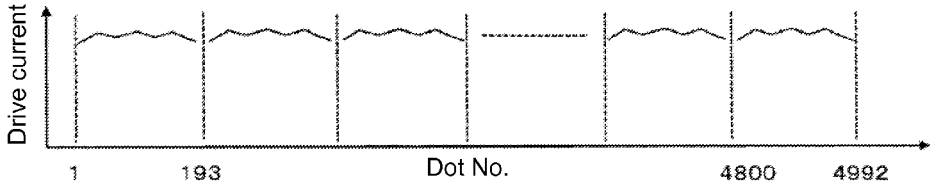
Figure 16D:
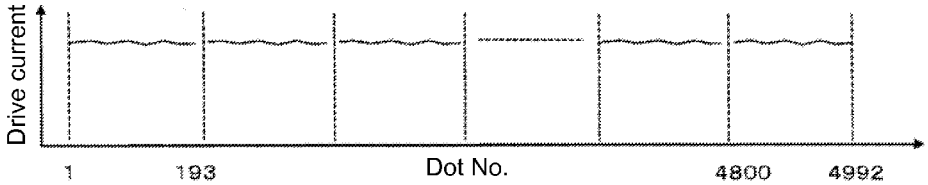

FIG. 15 is a schematic plan view showing the configuration of the PMOSs 118 to 122 as the drive transistors according to the second embodiment of the present invention. In the second embodiment, components similar to those in the first embodiment are designated with the same reference numerals.

In the second embodiment, the PMOSs 122 (122-1 and 122-2) as the main drive transistors and the PMOSs 118 to 121 (181-1 to 121-1 and 118-2 to 121-2) as the auxiliary transistors have gate wiring portions formed of a poly-silicon, and the gate wiring portions have a width (that is, a gate length of each of the transistors) different from that in the first embodiment.

As shown in FIG. 15, each of the PMOSs 118 to 121 (181-1 to 121-1 and 118-2 to 121-2) has the gate wiring portion with a width L (that is, a gate length of each of the PMOS transistors) similar to that in the first embodiment. Further, each of the PMOSs 122 (122-1 and 122-2) has the gate wiring portion with a width L1 (that is, a gate length of each of the gates 122-1G1 to 122-2G1 of the PMOSs 122-1 and 122-2) along the X axis direction and a width L2 (that is, a gate length of each of the gates 122-1G2 to 122-2G2 of the PMOSs 122-1 and 122-2) along the Y axis direction. It is configured such that the width L2 is larger than the width L1 (L2>L1). Other configurations are similar to those in the first embodiment.

An operation of the LED print head 13 will be explained. The LED print head 13 includes the drive circuit 110 shown in FIG. 8, and the drive circuit 110 includes the drive transistors shown in FIG. 13. In the second embodiment, the operation of the LED print head 13 is similar to that in the first embodiment, except that an operation associated with the configuration different from that in the first embodiment is different, and only the different operation will be explained below.

As explained above, in the MOS transistor, when a compressive stress is applied in the channel direction thereof, the carrier mobility increases. When a tensional stress is applied, the carrier mobility decreases. The phenomenon becomes more evident in the case of the MOS transistor with a short channel (that is, a short gate length).

In the second embodiment, in the PMOSs 122-1 and 122-2 as the main drive transistors shown in FIG. 15, the gate wiring portions of the gates 122-1G1 to 122-2G1 have the width L1 along the X axis direction, and the gate wiring portions of the gates 122-1G2 to 122-2G2 have the width L2 along the Y axis direction. Further, the width L2 is larger than the width L1 (L2>L1). With the configuration, when a stress is applied, a change rate of the drain current becomes larger in a transistor portion including the gates 122-1G2 to 122-2G2 with the gate length L2 along the Y axis direction than a transistor portion including the gates 122-1G1 to 122-2G1 with the gate length L1 along the X axis direction.

As a result, as opposed to the configuration of the drive transistors in the first embodiment shown in FIG. 1, it is possible to reduce the gate length L2 (the length of the gate wiring portion) along the Y axis direction, that is the length of the transistor portion including the gates 122-1G2 to 122-2G2. Accordingly, it is possible to reduce the size of the drive circuit 110 in the Y axis direction, thereby reducing the chip area of the driver ICs 100 (100-1 to 100-26).

FIGS. 16(*a*) to 16(*d*) are schematic views showing an operation of the LED print head 13 at a low environmental temperature (about −20° C.) according to the second embodiment of the present invention. In FIGS. 16(*a*) to 16(*d*), components similar to those shown in FIGS. 14(*a*) to 14(*d*) are designated with the same reference numerals.

FIG. 16(*a*) is a block diagram of the LED print head 13 corresponding to FIG. 9(*a*). As shown in FIG. 16(*a*), a plurality of the driver ICs 100 (100-1 to 100-26) is arranged to face a plurality of the LED arrays (CHP) 200 (200-1 to 200-26). Note that FIGS. 16(*b*) to 16(*d*) show the graphs corresponding to the block diagram shown in FIG. 16(*a*), and the driver ICs 100 are divided at boundaries represented with a hidden line.

FIG. 16(*b*) is a graph showing each of the drive currents of the LED print head 13 at the low environmental temperature. The drive currents correspond to the drain current components generated in the transistor portion having the gate 122-2G1 among the PMOS 118-1 to 122-1 and 118-2 to 122-2. As shown in FIG. 16(*b*), each of the drive currents of the driver ICs 100 (100-1 to 100-26) exhibits a downwardly curved profile having a slight decline at a middle portion thereof and a slight increase at an end portion thereof.

FIG. 16(*c*) is a graph showing each of the drive currents of the LED print head 13 at the low environmental temperature. The drive currents correspond to the drain current components generated in the transistor portion having the gate 122-2G2 among the PMOS 118-1 to 122-1 and 118-2 to 122-2. As shown in FIG. 16(*c*), each of the drive currents of the driver ICs 100 exhibits an upwardly curved profile having a slight increase at a middle portion thereof and a slight decline at an end portion thereof.

As shown in FIG. 15, among the drain currents of the PMOS 122-2, the drain current generated with the gate 122-2G1 flows in the Y axis direction perpendicular to the direction (X) in which the thermal stress is received from the print circuit board 13*b* when the LED print head 13 is placed in a low temperature environment. Accordingly, as explained with reference to FIGS. 10(*a*) and 10(*b*), the current change rate expressed with the equation (7) has a positive coefficient. Further, when an object is subject to a compressive stress σ, the compressive stress σ has a negative value. Accordingly, under the low temperature environment, the drive current or the dot current of the driver IC 100 has the downwardly curved profile having the slight decline at the middle portion thereof corresponding to the graph shown in FIG. 16(*b*).

Further, as shown in FIG. 15, among the drain currents of the PMOS 122-2, the drain current generated with the gate 122-2G2 flows in the X axis direction in parallel to the direction (X) in which the thermal stress is received from the print circuit board 13*b* when the LED print head 13 is placed in a low temperature environment. Accordingly, as explained with reference to FIGS. 10(*a*) and 10(*b*), the current change rate expressed with the equation (6) has a negative coefficient. Further, when an object is subject to a compressive stress σ, the compressive stress σ has a negative value. Accordingly, under the low temperature environment, the current change rate has a positive value, and the drive current or the dot current of the driver IC 100 has the upwardly curved profile having the slight increase at the middle portion thereof corresponding to the graph shown in FIG. 16(*c*).

FIG. 16(*d*) is a graph showing each of total drive currents controlled with an entire portion of the gates 122-2G1 and 122-2G2 of the PMOS 122-2, and corresponding to a sum of the drive currents or the dot currents shown in FIGS. 16(*b*) and 16(*c*).

As explained above, in FIG. 16(*b*), each of the drive currents of the driver ICs 100 exhibits the downwardly curved profile having the slight decline at the middle portion thereof and the slight increase at the end portion thereof. In FIG. 16(*c*), each of the drive currents of the driver ICs 100 exhibits the upwardly curved profile having the slight increase at the middle portion thereof and the slight decline at the end portion thereof. Accordingly, as shown in FIG. 16(*d*), as the sum of the drive currents shown in FIGS. 16(*b*) and 16(*c*), each of the drive currents exhibits a relatively flat profile having a relatively uniform value both at a middle portion and an end portion thereof.

As apparent from the comparison with the conventional LED print head shown in FIGS. 13(*b*) to 13(*d*), in the embodiment, the driver ICs 100 output the drive currents with a less variance as shown in FIGS. 16(*b*) to 16(*d*). Accordingly, in the image forming apparatus 1 with the LED print head 13, it is possible to obtain high print quality.

As shown in FIG. 15, in the embodiment, as opposed to the conventional LED print head shown in FIGS. 12(*a*) and 12(*b*), the PMOSs 118-1 to 122-1 and 118-2 to 122-2 as the drive transistors are arranged in the X axis direction with the arrangement width substantially double of the arrangement pitch P1 of the drive current output terminals PD1 and PD2. Further, the PMOSs 122-1 and 122-2 as the main drive transistors have the substantially L character shape. Further, the PMOS 122-1 for driving the drive current output terminal PD1 is arranged in the point symmetry with respect to the PMOS 122-2 for driving the drive current output terminal PD2, and an entire shape thereof is rectangular. Accordingly, it is possible to reduce an occupied area of the PMOSs 118-1 to 122-1 and 118-2 to 122-2 as the drive transistors of the driver IC 100, thereby reducing a chip area and manufacturing cost.

Further, in the embodiment, it is possible to reduce the length L2 of the gates 122-1G2 and 122-2G2 along the U axis direction of the driver ICs 100, thereby reducing the gate width of the transistor portion. Accordingly, it is possible to further reduce an occupied area of the drive transistors of the driver ICs 100 in the Y axis direction, thereby further reducing the chip area.

As described above, in the drive circuit 110 shown in FIG. 7 and the LED print head 13 shown in FIG. 4 using the drive circuit 110 in the embodiment, it is possible to reduce the difference in the drive currents at the end portion of the driver IC 100 and the middle portion of the driver IC 100 as opposed to the conventional configuration, thereby obtaining the drive currents in the driver IC 100 with the improved variance. Accordingly, similar to the first embodiment, it is possible to reduce a variance in the print density, and to provide the image forming apparatus 1 with high print quality.

Third Embodiment

A third embodiment of the present invention will be explained next. In the third embodiment, a drive transistor has a configuration different from that the drive transistors shown in FIG. 1 in the first embodiment. Other components in the second embodiment are similar to those in the first embodiment, and only the drive transistor with the different configuration will be explained.

Figure 17:
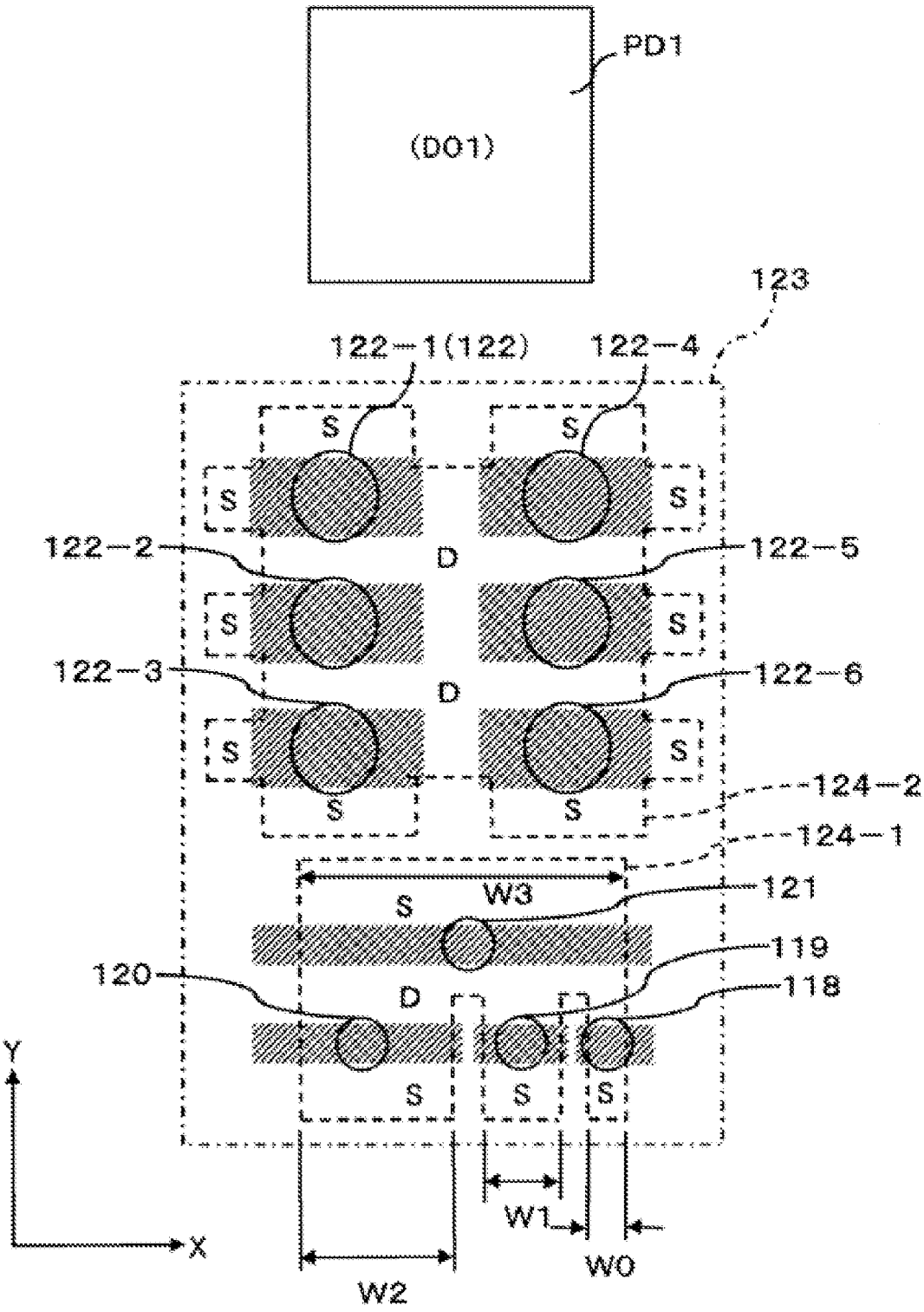
FIG. 17 is a schematic plan view showing a configuration of a drive transistor according to a third embodiment of the present invention.

FIG. 17 is a schematic plan view showing the configuration of the PMOSs 118 to 122 as the drive transistors according to the third embodiment of the present invention. In the third embodiment, components similar to those in the first embodiment are designated with the same reference numerals.

In FIG. 17, similar to FIG. 1, the X axis represents the long side of the driver IC 100 shown in FIG. 6, and corresponds to the arrangement direction of the driver ICs 100-1, 100-2, and so on shown in FIG. 5. The Y axis represents the short side of the driver IC 100 perpendicular to the X axis. Further, different from FIG. 1, FIG. 17 shows five of the PMOSs 118 to 122 as the drive transistors and the drive current output terminal PD1 for the dot data DO1.

In the embodiment, a drive portion 123 is represented as an area surrounded with a projected line, and diffused regions 124-1 and 124-2 with the P-type impurity are represented with hidden lines and formed in the drive portion 123. The PMOS 118 to 121 as the auxiliary drive transistors are formed in the diffused regions 124-1 with the P-type impurity. The PMOS 122 as the main drive transistor is formed in the diffused regions 124-2 with the P-type impurity. The PMOS 122 is formed of six transistor portions 122-1 to 122-6.

In the embodiment, gates G of the PMOSs 118 to 122 are represented with hatched areas, and are formed of, for example, poly-silicon. The gates G are not limited to poly-silicon, and may be formed of a material such as a metal. When the PMOSs 118 to 122 are formed, the P-type impurity is introduced into the diffused regions 124-1 and 124-2 with the gates G as a mask, so that the source regions S and drain regions D containing the P-type impurity are formed on both sides of the gates G.

Note that, similar to FIG. 1 in the first embodiment, for a simple explanation purpose, a gate oxide film, a metal wiring portion, a contact portion of the source regions S, a contact portion of the drain region D, and a passivation protective film, and the like are omitted in FIG. 15. Further, the source regions S are connected to the power source voltage terminal VDD through metal wiring portions (not shown), and the drain regions D are connected to the drive current output terminal PD1 for the dot data DO1 through metal wiring portions (not shown), respectively.

In the embodiment, similar to the first embodiment, the PMOSs 118 to 121 have an identical gate wiring portion width. Further, the PMOSs 118 to 121 have the gates with gate widths W0, W1, W2, and W3, respectively. The gate width W1 is equal to double of the gate width W0 (W1=2×W0). The gate width W2 is equal to quadruple of the gate width W0 (W2=4×W0). The gate width W3 is equal to eight times of the gate width W0 (W3=8×W0). Further, the transistor portions 122-1 to 122-6 constituting the PMOS 122 have an identical gate wiring portion width and an identical gate width.

An operation of the LED print head 13 will be explained. The LED print head 13 includes the drive circuit 110 shown in FIG. 8, and the drive circuit 110 includes the drive transistors shown in FIG. 17. In the third embodiment, the operation of the LED print head 13 is similar to that in the first embodiment, except that an operation associated with the configuration different from that in the first embodiment is different, and only the different operation will be explained below.

In particular, the operation of the PMOSs 118 to 121 as the auxiliary drive transistors is similar to that in the first embodiment. An operation of the PMOS 122 as the main drive transistor is different from that in the first embodiment. Accordingly, an operation of one (for example, the Y axis direction explained with reference to FIG. 10(*a*). Further, the drain current flows obliquely from the source region 122-1S1 toward the drain region 122-1D1 in a hidden line arrow direction, thereby generating a combined current of the channel currents in the Y axis direction and the Y axis direction explained with reference to FIG. 10(*a*).

Figure 18A:
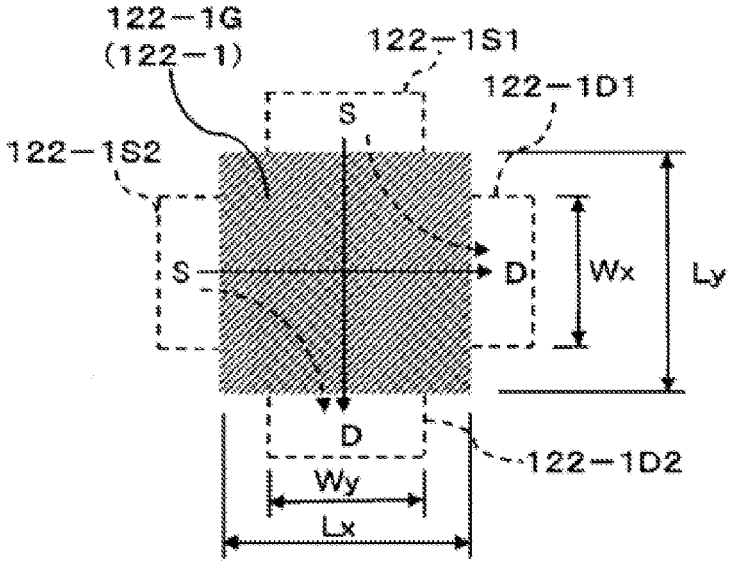
FIGS. 18(*a*) to 18(*c*) are schematic plan views showing a transistor portion of the drive transistor according to the third embodiment of the present invention.
Figure 18B:
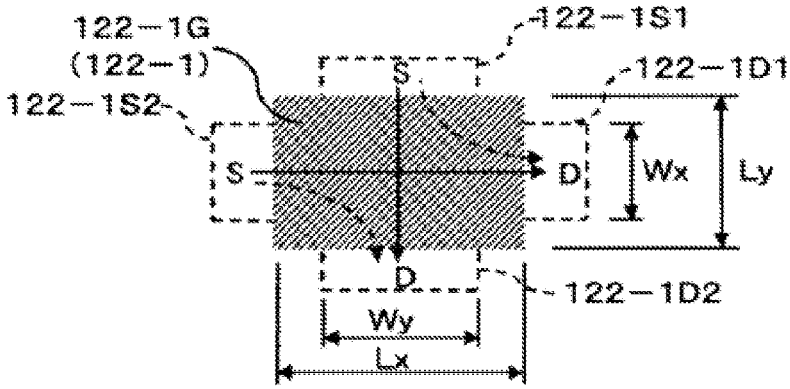
Figure 18C:
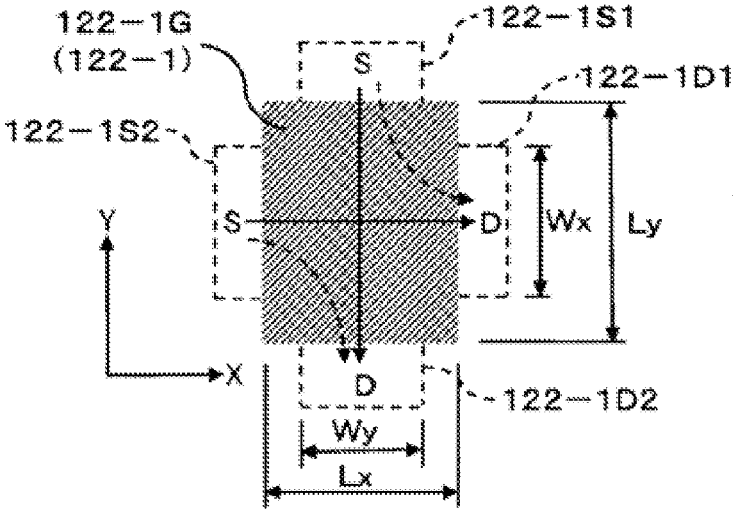

Accordingly, in the transistor portion 122-1 shown in FIG. 18(*a*), it is configured such that the current component in the X axis direction becomes substantially equal to that in the Y axis direction.

As shown in FIG. 18(*b*), the drain current flows laterally from the source region 122-1S2 toward the drain region 122-1D1 in a solid line direction along the X axis direction, thereby generating the channel current in the X axis direction explained with reference to FIG. 10(*a*). Further, the drain current flows vertically from the source region 122-1S1 toward the drain region 122-1D2 in a solid line arrow direction along the Y axis direction, thereby generating the channel current in the Y axis direction explained with reference to FIG. 10(*a*).

As explained above, in the configuration shown in FIG. 18(*b*), the gate 122-1G has the length Lx greater than the length Ly (Ly/Lx<1). Since the current component through a shorter route becomes larger, the current component in the Y axis direction becomes larger than the current component in the X axis direction.

Further, the drain current flows obliquely from the source region 122-1S2 toward the drain region 122-1D2 in a hidden line arrow direction, thereby generating a combined current of the channel currents in the Y axis direction and the Y axis direction explained with reference to FIG. 10(*a*). Further, the drain current flows obliquely from the source region 122-1S1 toward the drain region 122-1D1 in a hidden line arrow direction, thereby generating a combined current 122-1) of the transistor portions 122-1 to 122-6 constituting the PMOS 122 will be explained.

FIGS. 18(*a*) to 18(*c*) are schematic plan views showing the one (for example, 122-1) of the transistor portions 122-1 to 122-6 constituting the PMOS 122 according to the third embodiment of the present invention.

As shown in FIG. 18(*a*), the transistor portion 122-1 includes a gate 122-1G, source regions 122-1S1 and 122-1S2, and drain regions 122-1D1 and 122-1D2. The gate 122-1G has a length Lx in the X axis direction and a length Ly in the Y axis direction. The length Lx is substantially the same as the length Ly (Ly/Lx≈1).

As shown in FIG. 18(*b*), similar to FIG. 18(*a*), the gate 122-1G has the length Lx in the X axis direction and the length Ly in the Y axis direction. The length Lx is greater than the length Ly (Ly/Lx<1). As shown in FIG. 18(*c*), similar to FIG. 18(*a*), the gate 122-1G has the length Lx in the X axis direction and the length Ly in the Y axis direction. The length Lx is smaller than the length Ly (Ly/Lx>1).

As shown in FIG. 18(*a*), the drain current flows laterally from the source region 122-1S2 toward the drain region 122-1D1 in a solid line direction along the X axis direction, thereby generating the channel current in the X axis direction explained with reference to FIG. 10(*a*). Further, the drain current flows vertically from the source region 122-1S1 toward the drain region 122-1D2 in a solid line arrow direction along the Y axis direction, thereby generating the channel current in the Y axis direction explained with reference to FIG. 10(*a*).

Further, the drain current flows obliquely from the source region 122-1S2 toward the drain region 122-1D2 in a hidden line arrow direction, thereby generating a combined current of the channel currents in the Y axis direction and of the channel currents in the Y axis direction and the Y axis direction explained with reference to FIG. 10(*a*). It can be assumed that the combined current in the former case is substantially the same as that in the latter case. Accordingly, a combined current of the currents in the solid line arrow and the hidden line arrow in the Y axis direction becomes larger than a combined current of the currents in the solid line arrow and the hidden line arrow in the X axis direction.

As shown in FIG. 18(*c*), the drain current flows laterally from the source region 122-1S2 toward the drain region 122-1D1 in a solid line direction along the X axis direction, thereby generating the channel current in the X axis direction explained with reference to FIG. 10(*a*). Further, the drain current flows vertically from the source region 122-1S1 toward the drain region 122-1D2 in a solid line arrow direction along the Y axis direction, thereby generating the channel current in the Y axis direction explained with reference to FIG. 10(*a*).

As explained above, in the configuration shown in FIG. 18(*c*), the gate 122-1G has the length Lx smaller than the length Ly (Ly/Lx>1). Since the current component through a shorter route becomes larger, the current component in the X axis direction becomes larger than the current component in the Y axis direction.

Further, the drain current flows obliquely from the source region 122-1S2 toward the drain region 122-1D2 in a hidden line arrow direction, thereby generating a combined current of the channel currents in the Y axis direction and the Y axis direction explained with reference to FIG. 10(*a*).

Further, the drain current flows obliquely from the source region 122-1S1 toward the drain region 122-1D1 in a hidden line arrow direction, thereby generating a combined current of the channel currents in the Y axis direction and the Y axis direction explained with reference to FIG. 10(*a*). It can be assumed that the combined current in the former case is substantially the same as that in the latter case. Accordingly, a combined current of the currents in the solid line arrow and the hidden line arrow in the X axis direction becomes larger than a combined current of the currents in the solid line arrow and the hidden line arrow in the Y axis direction.

As explained above, in the embodiment, through changing the shape of the gate 122-1G formed of poly-silicon, it is possible to arbitrarily adjust the ratio between the current component flowing in the X axis direction and the current component flowing in the Y axis direction.

Figures 19A, 19B, 19C, 19D:
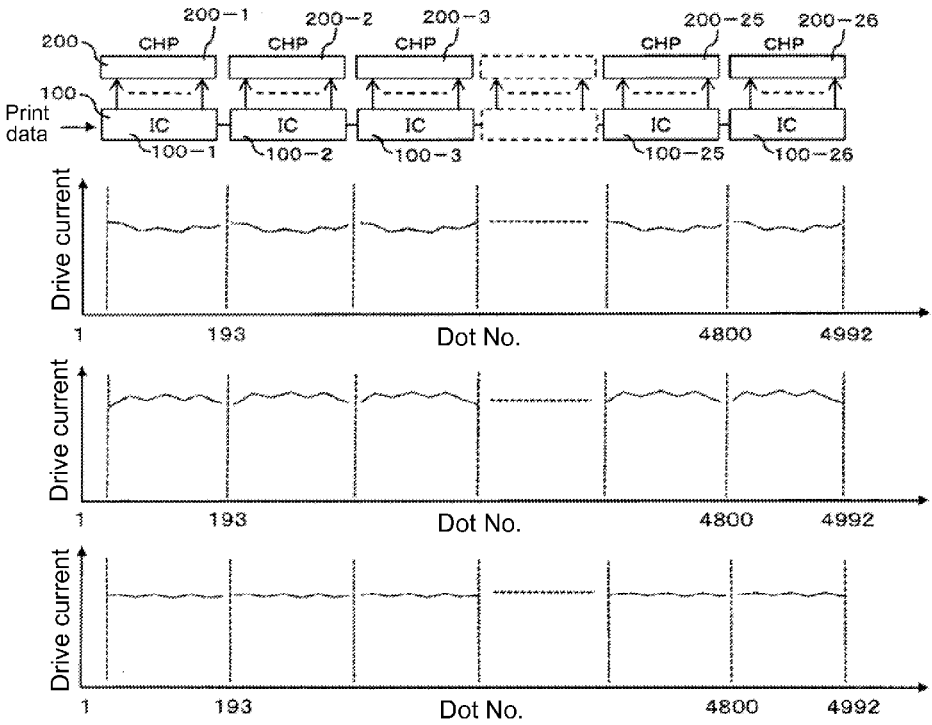
FIGS. 19(*a*) to 19(*d*) are schematic views showing an operation of an LED print head at a low environmental temperature according to the second embodiment of the present invention.

FIGS. 19(*a*) to 19(*d*) are schematic views showing an operation of the LED print head 13 at a low environmental temperature (about −20° C.) according to the third embodiment of the present invention. In FIGS. 19(*a*) to 19(*d*), components similar to those shown in FIGS. 14(*a*) to 14(*d*) are designated with the same reference numerals.

FIG. 19(*a*) is a block diagram of the LED print head 13 corresponding to FIG. 9(*a*). As shown in FIG. 19(*a*), a plurality of the driver ICs 100 (100-1 to 100-26) is arranged to face a plurality of the LED arrays (CHP) 200 (200-1 to 200-26). Note that FIGS. 19(*b*) to 19(*d*) show the graphs corresponding to the block diagram shown in FIG. 19(*a*), and the driver ICs 100 are divided at boundaries represented with a hidden line.

FIG. 19(*b*) is a graph showing each of the drive currents of the LED print head 13 at the low environmental temperature. The drain current components of the PMOS 118 to 122 shown in FIG. 17 flow in the Y axis direction. As shown in FIG. 19(*b*), each of the drive currents exhibits a downwardly curved profile having a slight decline at a middle portion of the driver ICs 100 (100-1 to 100-26) and a slight increase at an end portion thereof.

More specifically, the current components shown in FIG. 19(*b*) flow in the Y axis direction perpendicular to the direction (X) in which the thermal stress is received from the print circuit board 13*b* when the LED print head 13 is placed in a low temperature environment. Accordingly, as explained with reference to FIGS. 10(*a*) and 10(*b*), the current change rate expressed with the equation (7) has a positive coefficient. Further, when an object is subject to a compressive stress σ, the compressive stress σ has a negative value. Accordingly, under the low temperature environment, the drive current or the dot current of the driver IC 100 has the downwardly curved profile having the slight decline at the middle portion thereof corresponding to the graph shown in FIG. 19(*b*).

FIG. 19(*c*) is a graph showing each of the drive currents of the LED print head 13 at the low environmental temperature. The drain current components of the PMOS 118 to 122 shown in FIG. 17 flow in the X axis direction. As shown in FIG. 19(*c*), each of the drive currents exhibits an upwardly curved profile having a slight increase at a middle portion of the driver ICs 100 (100-1 to 100-26) and a slight decline at an end portion thereof.

More specifically, the current components shown in FIG. 19(*c*) flow in the X axis direction in parallel to the direction (X) in which the thermal stress is received from the print circuit board 13*b* when the LED print head 13 is placed in a low temperature environment. Accordingly, as explained with reference to FIGS. 10(*a*) and 10(*b*), the current change rate expressed with the equation (6) has a negative coefficient. Further, when an object is subject to a compressive stress σ, the compressive stress σ has a negative value. Accordingly, under the low temperature environment, the drive current or the dot current of the driver IC 100 has the upwardly curved profile having the slight increase at the middle portion thereof corresponding to the graph shown in FIG. 19(*c*).

FIG. 19(*d*) is a graph showing each of total drive currents corresponding to a sum of the drive currents or the dot currents shown in FIGS. 19(*b*) and 19(*c*).

As explained above, in FIG. 19(*b*), each of the drive currents of the driver ICs 100 exhibits the downwardly curved profile having the slight decline at the middle portion thereof and the slight increase at the end portion thereof. In FIG. 19(*c*), each of the drive currents of the driver ICs 100 exhibits the upwardly curved profile having the slight increase at the middle portion thereof and the slight decline at the end portion thereof. Accordingly, as shown in FIG. 19(*d*), as the sum of the drive currents shown in FIGS. 19(*b*) and 19(*c*), each of the drive currents exhibits a relatively flat profile having a relatively uniform value both at a middle portion and an end portion thereof.

As apparent from the comparison with the conventional LED print head shown in FIGS. 13(*b*) to 13(*d*), in the embodiment, the driver ICs 100 output the drive currents with a less variance as shown in FIGS. 19(*b*) to 19(*d*). Accordingly, in the image forming apparatus 1 with the LED print head 13, it is possible to obtain high print quality.

As described above, in the drive circuit 110 shown in FIG. 7 and the LED print head 13 shown in FIG. 4 using the drive circuit 110 in the embodiment, it is possible to reduce the difference in the drive currents at the end portion of the driver IC 100 and the middle portion of the driver IC 100 as opposed to the conventional configuration, thereby obtaining the drive currents in the driver IC 100 with the improved variance. Accordingly, similar to the first embodiment, it is possible to reduce a variance in the print density, and to provide the image forming apparatus 1 with high print quality.

Note that the present invention is not limited to the first to third embodiment described above, and may be modified in various applications as follows.

In the first to third embodiment described above, the present invention is applied to the light emitting elements using the LEDs as the light source. The present invention is not limited thereto, and may be applicable to a configuration for controlling a voltage applied to other driven elements (for example, an organic EL element, a heating resistor member, and the like). More specifically, the present invention is applicable to a printer having an organic EL head formed of an array of organic EL elements, or a thermal printer having an array of heating resistor members. Further, the present invention is applicable for driving display elements (for example, display elements arranged in a row or a matrix pattern, and the like).

In the first to third embodiment described above, the present invention is applied to the LEDs with two-terminal structure as the driven elements. The present invention is not limited thereto, and may be applicable for driving a light emitting thyristor with a three-terminal structure or a four-terminal thyristor SCS (Silicon Semiconductor Controlled Switch) having first and second gate terminals.

Further, the present invention is not limited to the drive circuit of the driven element row in which the identically configured elements are continuously arranged, and may be applicable to an IC chip with a plurality of drive terminal outputs and the like.

The disclosure of Japanese Patent Application No. 2009-011848, filed on Jan. 22, 2009, is incorporated in the application by reference.

While the invention has been explained with reference to the specific embodiments of the invention, the explanation is illustrative and the invention is limited only by the appended claims.

What is claimed is:

1. A drive circuit for supplying a drive current to a plurality of driven elements, comprising:

a plurality of drive output terminals to be connected to the driven elements, said drive output terminals being arranged with a specific pitch in between in an arrangement direction; and a plurality of drive transistors, each of said drive transistors being arranged in an occupied area with a specific width in the arrangement direction larger than the specific pitch.

2. The drive circuit according to claim 1, wherein said drive transistors are formed in an L character shape extending over the output terminals.

3. The drive circuit according to claim 1, wherein said drive transistors are formed in an L character shape extending over the output terminals so that a ratio between a first length of the L character shape in a first direction and a second length of the L character shape in a second direction is adjusted according to Poisson ratio of a board material on which the drive transistors are formed.

4. The drive circuit according to claim 1, wherein said drive transistors are formed in an L character shape extending over the output terminals and having a first length Lx in a direction that the drive transistors are arranged and a second length Ly in another direction so that a ratio of the second length Ly relative to a total length (Lx+Ly) of the drive transistors is set within a range between 0.15 and 0.6 ($0.15 \leqq Ly/(Lx+Ly) \leqq 0.60$).

5. A drive circuit comprising:

a plurality of drive output terminals to be connected to the driven elements, said drive output terminals being arranged with a specific pitch in between in an arrangement direction; and a plurality of drive transistors for supplying a drive current to a plurality of driven elements, each of said drive transistors being arranged in an occupied area with a specific width in the arrangement direction larger than the specific pitch, said drive transistors being formed in an L character shape and having a first gate length in a first direction and a second gate length in a second direction, said first gate length being different from the second gate length.

6. A drive circuit comprising:

a drive transistor for supplying a drive current to a plurality of driven elements, said drive transistor including a gate electrode having a rectangular shape, a source region disposed along a first side and a second side of the rectangular shape, and a drain region disposed along a third side and a fourth side of the rectangular shape.

7. The drive circuit according to claim 6, wherein said gate electrode has the rectangular shape having the first side and the second side, said second side having a length different from that of the first side.

8. An optical print head comprising a circuit board, a plurality of the drive circuits according to claim 1, a light emitting element array formed of the driven elements, and a lens array for collecting light emitted from the light emitting element array.

9. An optical print head comprising a circuit board, a plurality of the drive circuits according to claim 5, a light emitting element array formed of the driven elements, and a lens array for collecting light emitted from the light emitting element array.

10. An optical print head comprising a circuit board, a plurality of the drive circuits according to claim 6, a light emitting element array formed of the driven elements, and a lens array for collecting light emitted from the light emitting element array.

11. An image forming apparatus comprising the optical print head according to claim 8 and a photosensitive member arranged to face the optical print head.

12. An image forming apparatus comprising the optical print head according to claim 9 and a photosensitive member arranged to face the optical print head.

13. An image forming apparatus comprising the optical print head according to claim 10 and a photosensitive member arranged to face the optical print head.

* * * * *